US006244230B1

(12) United States Patent
Mikame

(10) Patent No.: US 6,244,230 B1
(45) **Date of Patent: *Jun. 12, 2001**

(54) VARIABLE VALVE TIMING APPARATUS

(75) Inventor: Kazuhisa Mikame, Nagoya (JP)

(73) Assignee: Toyota Jidosha Kabushiki Kaisha, Toyota (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/250,275

(22) Filed: Feb. 16, 1999

(30) Foreign Application Priority Data

Feb. 20, 1998 (JP) ..... 10-038796

(51) Int. Cl.[7] ..... F01L 1/34
(52) U.S. Cl. ..... 123/90.17; 123/90.18
(58) Field of Search ..... 123/90.15, 90.16, 123/90.17, 90.18, 90.31

(56) References Cited

U.S. PATENT DOCUMENTS

| | | | |
|---|---|---|---|
| 4,517,936 | 5/1985 | Burgio di Aragona | 123/90.5 |
| 4,693,214 | 9/1987 | Titolo | 123/90.18 |
| 5,497,737 | 3/1996 | Nakamura | 123/90.15 |

FOREIGN PATENT DOCUMENTS

| | | |
|---|---|---|
| 0 699 831 A2 | 3/1996 | (EP) . |
| 0 808 997 A1 | 11/1997 | (EP) . |
| 0 590 577 A1 | 4/1994 | (JP) . |
| 7-301106 | 11/1995 | (JP) . |
| 9-32519 | 2/1997 | (JP) . |
| 9-60508 | 3/1997 | (JP) . |

OTHER PUBLICATIONS

A. Titolo, The Variable Valve Timing System—Application on a V8 Engine, pp. 8–15, (1991).

*Primary Examiner*—Weilun Lo
(74) *Attorney, Agent, or Firm*—Oliff & Berridge, PLC

(57) ABSTRACT

A variable valve timing apparatus is employed in an engine that includes a crankshaft, an intake camshaft for driving intake valves, an exhaust camshaft for driving exhaust valves, and a transmission for transmitting rotation between the crankshaft, the intake camshaft, and the exhaust camshaft. The variable valve timing apparatus varies the valve timing of the intake valves or the exhaust valves. A first actuator is incorporated in the transmission to adjust the rotational phase of the intake camshaft or the exhaust camshaft relative to the crankshaft. A second actuator is arranged on the intake camshaft or the exhaust camshaft to adjust the valve lift of the associated valves. The result is a compact engine that avoids interference with other parts in the engine compartment.

14 Claims, 19 Drawing Sheets

4
24b
24a
38
40
82
36
24
42
50a
50
30
54
52
22a
22
58
48
56
98
94
92
100
34
104
96
108
106
102
32
60
76
90
70
110
46
44
78
112
14a
88
42
86
4
ECU
180
P1
P2
24b
26
114
136
120
132
118
116
134
138
122
132
126
132
124
132
130
128
P
13a

VARIABLE VALVE TIMING APPARATUS

BACKGROUND OF THE INVENTION

The present invention relates to variable valve timing apparatuses that are employed in engines. More particularly, the present invention relates to a variable timing apparatus that includes a phase adjustor and a lift adjustor for controlling the valve timing of intake valves and exhaust valves with cams.

Engine variable valve timing apparatuses control the valve timing of intake valves and exhaust valves in accordance with the operating state of the engine. A variable valve timing apparatus generally includes a timing pulley and a sprocket, which synchronously rotate a camshaft with a crankshaft.

Japanese Unexamined Patent Publication No. 9-60508 describes a typical variable timing apparatus, which is represented by FIGS. 18, 19, and 20. The variable valve timing apparatus includes a phase adjustor, or first actuator, arranged on one end of a camshaft 1202. FIG. 18 is a cross-sectional view taken along line 18—18 in FIG. 19, while FIG. 19 is a cross-sectional view taken along line 19—19 in FIG. 18. FIG. 20 is a cross-sectional view taken along line 20—20 in FIG. 19.

A sprocket 1204, which is driven by a crankshaft (not shown), is integrally coupled with a housing 1206. A vane rotor 1208 is arranged in the center of the housing 1206 and secured to the end of the camshaft 1202 to rotate integrally with the camshaft 1202.

Vanes 1210 project outward from the hub of the vane rotor 1208 to contact the inner wall of the housing 1206. Partitions 1212 project inward from the housing 1206 to contact the hub surface of the vane rotor 1208. Cavities 1214 are defined between the partitions 1212. A first pressure chamber 1216 and a second pressure chamber 1218 are defined in each cavity 1214 between each vane 1210 and the partitions 1212.

Hydraulic fluid is delivered to the first and second pressure chambers 1216, 1218 to rotate the vane rotor 1208 relative to the housing 1206. As a result, the rotational phase of the vane rotor 1208 relative to the housing 1206 is adjusted. This, in turn, adjusts the rotational phase of the camshaft 2102 relative to the crankshaft and varies the valve timing of the intake valves or exhaust valves.

The camshaft 1202 has a journal 1224, which is supported by a bearing 1222 formed in a cylinder head of the engine. An oil channel, which is connected with a hydraulic unit 1220, extends through the cylinder head and connects to an oil groove 1226 extending along the peripheral surface of the camshaft journal 1224. The oil groove 1226 is connected to oil conduits 1227, 1228, which extend through the camshaft 1202. The oil conduit 1228 is further connected to oil conduits 1230, 1232, which extend through the vane rotor 1208 and lead into the first pressure chambers 1216. Accordingly, hydraulic fluid is forced from the hydraulic unit 1220 to the first pressure chambers 1216 through the oil channel, the oil groove 1226 and the oil conduits 1227, 1228, 1230, 1232. A further oil channel, which is connected with the hydraulic unit 1220, extends through the cylinder head and connects to an oil groove 1236, which extends along peripheral surface of the journal 1224. The oil groove 1236 is connected to an oil conduit 1238, which extends through the camshaft 1202. The oil conduit 1238 is further connected to oil conduits 1240, 1242, 1244, which extend through the vane rotor 1208 and lead into the second pressure chambers 1218. Accordingly, hydraulic pressure is communicated between the hydraulic unit 1220 and the second pressure chambers 1218 through the oil channel, the oil groove 1236, and the oil conduits 1238, 1240, 1242, 1244.

In addition to the first actuator, a lift adjustor, or second actuator, employed in a variable valve timing apparatus to change the lift amount and timing of intake or exhaust valves with a three-dimensional cam, is also known in the prior art. Japanese Unexamined Patent Publication No. 9-32519 describes a typical second actuator, which is represented by FIG. 21. Three-dimensional cams 1302 are arranged on a camshaft 1304. A timing pulley 1306 is arranged on one end of the camshaft 1304. The timing pulley 1306 is supported such that it slides axially along and rotates integrally with the camshaft 1304. A cylinder 1308 is arranged on one side of the timing pulley 1306. A piston 1310, secured to the end of the camshaft 1304, is fitted into the cylinder 1308. A pressure chamber 1312 is defined between one side of the piston 1310 and the inner wall of the cylinder 1308. A compressed spring 1314 is arranged between the other side of the piston 1310 and the timing pulley 1306. When the pressure in the pressure chamber 1312 is high, the piston 1310 urges the camshaft 304 against the force of the spring 1314 toward the right (as viewed in FIG. 21). When the pressure in the pressure chamber 1312 is low, the spring 1314 pushes the piston 1310 and forces the camshaft 1304 toward the left.

Hydraulic fluid is delivered to the pressure chamber 1312 from an oil control valve 1318 through oil conduits 1322, 1324, which extend through a bearing 1320, oil conduits 1326, 1328, which extend through the camshaft 1304, and an oil conduit 1332, which extends through a bolt 1330. The bolt 1330 fastens the piston 1310 to the camshaft 1304. A microcomputer 1316 controls the oil control valve 1318 to adjust the hydraulic pressure in the pressure chamber 1312 and change the axial position of the camshaft 1304.

Accordingly, the position of contact between each three-dimensional cam 1302 and the associated valve lift mechanism is adjusted to vary the opening duration of a corresponding intake valve or exhaust valve in accordance with the profile of the cam 1302. This varies the valve timing.

When changing the rotational phase of a camshaft relative to a crankshaft with the prior art first actuator to vary the valve timing, the opening and closing timing of the valves are both varied in the same manner. That is, if the opening timing is advanced, the closing timing is advanced accordingly, and if the opening timing is retarded, the closing timing is retarded accordingly. On the other hand, when changing the lift amount of the valves with the prior art second actuator to vary the valve timing, the opening timing and closing timing of the valves vary inversely at the same rate. That is, if the opening timing is retarded by a certain rate, the closing timing is advanced by the same rate, and if the opening timing is advanced by a certain rate, the closing timing is retarded by the same rate. Therefore, the opening and closing timing of the valves cannot be independently varied. This limits the control of the valve timing.

To solve this problem, the first actuator and the second actuator can be arranged together on a camshaft to adjust both the rotational phase of a camshaft relative to a crankshaft and the lift amount of the valves. This would reduce the limitations on the opening and closing timing control.

For example, as shown in FIG. 22, which illustrates an intake camshaft 1402 and an exhaust camshaft 1404, a first actuator 1408 may be arranged on one end of the intake camshaft 1402, and a second actuator 1410 may be arranged on the other end of the intake camshaft 1402. The first actuator 1408 includes a timing sprocket 1406.

However, the structure formed by installing the first actuator 1408 and the second actuator 1410 on the same intake camshaft 1402 results in a longer camshaft 1402. This would also increase the size of the engine and occupy more space in the engine compartment, and space is very limited.

SUMMARY OF THE INVENTION

Accordingly, it is an objective of the present invention to provide a variable valve timing apparatus employing a phase adjustor and a lift adjustor that enables unlimited control of the valve timing without occupying additional space in the engine compartment.

To achieve the above objective, the present invention provides a variable valve timing apparatus employed in an engine to vary the valve timing of intake valves or exhaust valves. The engine includes a crankshaft, an intake camshaft for driving the intake valves, an exhaust camshaft for driving the exhaust valves, and a transmission for transmitting rotation between the crankshaft, the intake camshaft, and the exhaust camshaft. The variable valve timing apparatus includes a first actuator incorporated in the transmission and a second actuator arranged on the intake camshaft or the exhaust camshaft. The first actuator adjusts the rotational phase of the intake camshaft or the exhaust camshaft relative to the crankshaft. The second actuator adjusts the valve lift of the valves driven by the camshaft on which the second actuator is arranged.

Other aspects and advantages of the present invention will become apparent from the following description, taken in conjunction with the accompanying drawings, illustrating by way of example the principles of the invention.

DETAILED DESCRIPTION OF THE PREFERRED EMBODIMENTS

A first embodiment according to the present invention will now be described with reference to FIGS. 1 to 8. In the first embodiment, a variable valve timing apparatus 10 is arranged on an intake camshaft and an exhaust camshaft of an engine.

Figure 1:
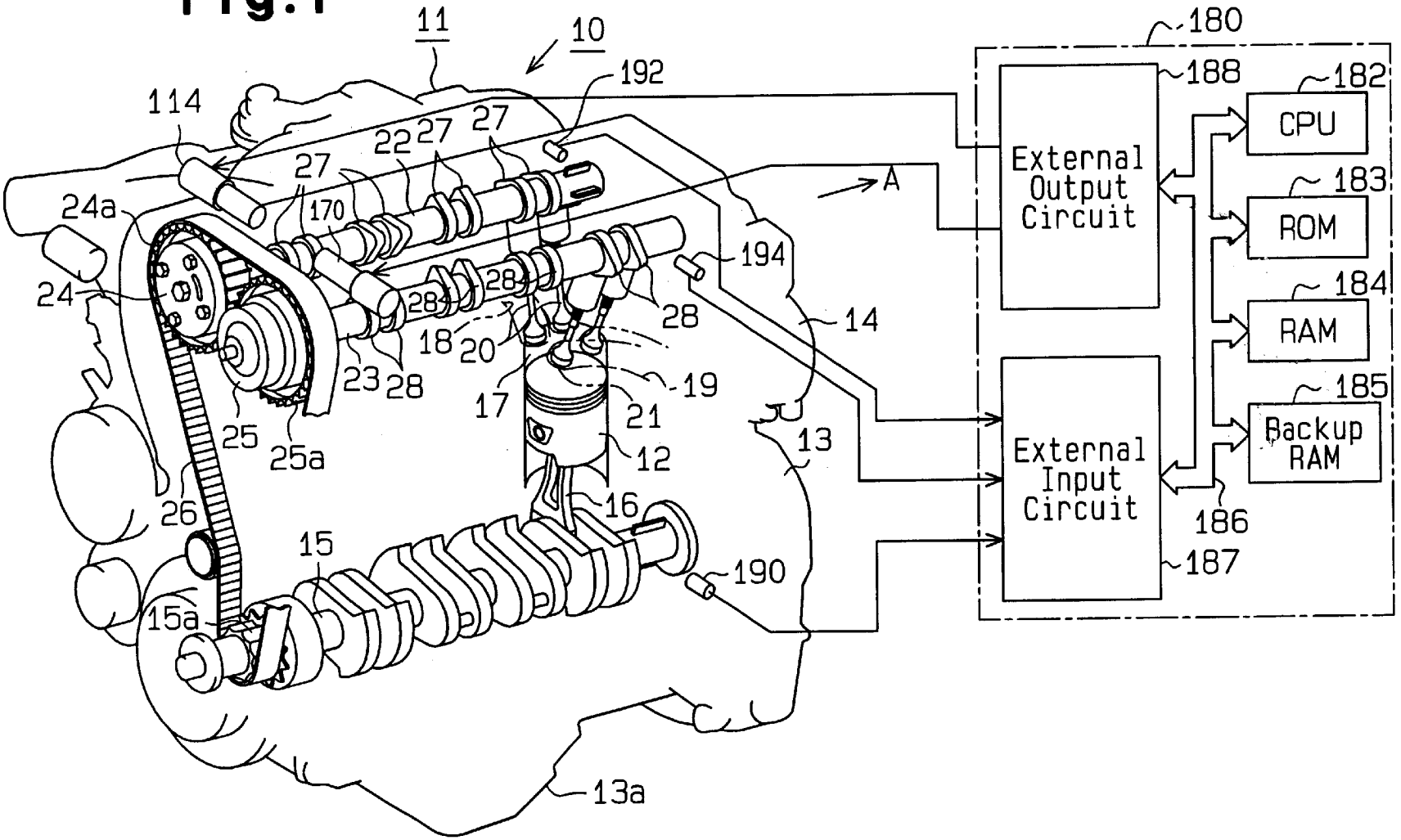
FIG. 1 is a partial perspective view combined with a block diagram showing an engine employing a variable valve timing apparatus according to a first embodiment of the present invention.

FIG. 1 shows an in-line four-cylinder gasoline engine 11 mounted in an automobile. The engine 11 includes a cylinder block 13 housing pistons 12 (only one shown), an oil pan **13*a* located below the cylinder block 13, and a cylinder head 14 covering the cylinder block 13**.

A crankshaft 15 is rotatably supported in the lower portion of the engine 11. Each piston 12 is connected to the crankshaft 15 by a connecting rod 16. The connecting rod 16 converts the reciprocal movement of the piston 12 to rotation of the crankshaft. A combustion chamber 17 is defined above the piston 12. An intake manifold 18 and an exhaust manifold 19 are connected to the combustion chamber 17. Each combustion chamber 17 and the intake manifold 18 are selectively connected to and disconnected from each other by intake valves 20. Each combustion chamber 17 and the exhaust manifold 19 are selectively connected to and disconnected from each other by exhaust valves 21.

An intake camshaft 22 and a parallel exhaust camshaft 23 extend through the cylinder head 14. The intake camshaft 22 is supported such that it is rotatable, though axially fixed, in the cylinder head 14. The exhaust camshaft 23 is supported such that it is rotatable and axially movable in the cylinder head 14.

A phase adjustor, or first actuator 24, including an intake timing pulley **24*a*, is arranged on one end of the camshaft 22. The first actuator 24 rotates the intake camshaft 22 relative to the timing pulley 24***a* and adjusts the rotational phase of the intake camshaft 22 relative to the crankshaft 15. A lift adjustor, or second actuator 25, including an exhaust timing pulley 25*a*, is arranged on an end of the exhaust camshaft 23 that corresponds with the first actuator 24. The second actuator 25 moves the exhaust camshaft 23 axially to adjust the lift amount and opening duration of the exhaust valves 21. The intake timing pulley 24*a* and the exhaust timing pulley 25 are connected to a crank timing pulley 15*a*, which is secured to a crankshaft 15, by a timing belt 26. The timing belt 26 transmits the rotation of the crankshaft 15, serving as a drive shaft, to the intake camshaft 22 and the exhaust camshaft 23, which serve as driven shafts. Thus, the intake camshaft 22 and the exhaust camshaft 23 are rotated synchronously with the crankshaft 25.

An intake cam 27 is arranged on the intake camshaft 22 in correspondence with each intake valve 20. Each intake cam 27 contacts the top of the associated intake valve 20. An exhaust cam 28 is arranged on the exhaust camshaft 23 in correspondence with each exhaust valve 21. Each exhaust cam 28 contacts the top of the associated exhaust valve 21. Rotation of the intake camshaft 22 opens and closes the intake valves 20 with the associated intake cams 27, while rotation of the exhaust camshaft 23 opens and closes the exhaust valves 21 with the associated exhaust cams 28.

Figure 2:
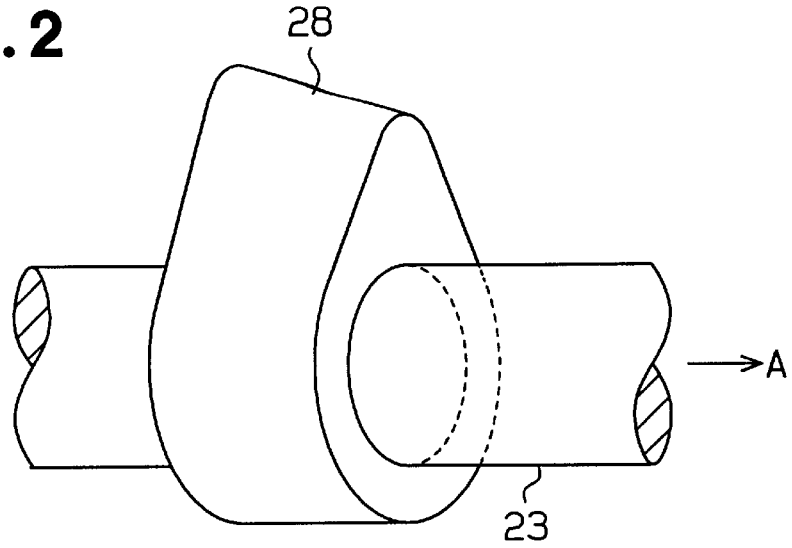
FIG. 2 is a partial perspective showing the exhaust cam of FIG. 1.

The profiles of the intake cams 27 do not very in the axial direction of the intake camshaft 22. However, as shown in FIG. 2, the profiles of the exhaust cams 28 vary continuously in the axial direction of the exhaust camshaft 23. Accordingly, each exhaust cam 27 functions as a three-dimensional cam.

Movement of the exhaust camshaft 23 in the direction of arrow A, as viewed in FIGS. 1 and 2, causes each exhaust cam 27 to gradually increase the lift amount of the associated exhaust valve 21. This gradually advances the opening timing of the exhaust valves 21 and retards the closing timing of the exhaust valves 21. Thus, the opening duration of the exhaust valves 21 gradually increases. Movement of the exhaust camshaft 23 in the direction opposite to that indicated by arrow A causes each exhaust cam 28 to gradually decrease the lift amount of the associated exhaust valves 21. This gradually retards the opening timing of the exhaust valves 21 and advances the closing timing of the exhaust valves 21. Thus, the opening duration of the exhaust valve 21 gradually decreases. Accordingly, axial movement of the exhaust camshaft 23 adjusts the lift amount and opening duration of the exhaust valves 21.

Figure 3:
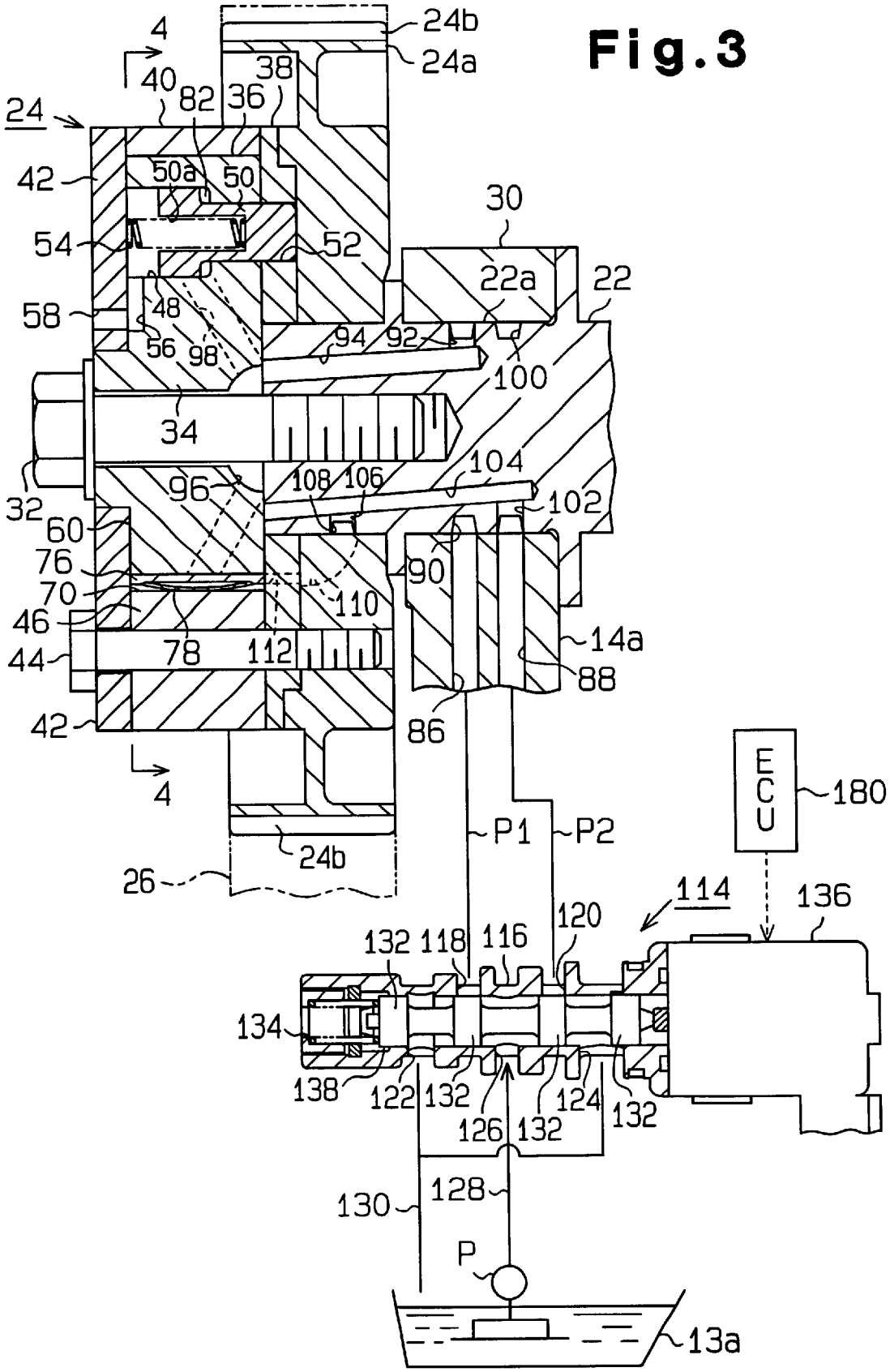
FIG. 3 is a schematic cross-sectional view showing a first actuator incorporated in the variable valve timing apparatus of FIG. 1.

The first actuator 24 and its hydraulic drive structure will now be described in detail with reference to FIGS. 3 to 6. As shown in FIG. 3, the intake camshaft 22 has a journal 22*a*. The cylinder head 14 has a bearing 14*a* and a bearing cap 30. The journal 22*a* is supported between the bearing 14*a* and the bearing cap 30 such that the intake camshaft 22 is rotatable. A vane rotor 34 is fastened to one end of the intake camshaft 22 by a bolt 32. A knock pin (not shown) fixes the vane rotor 34 to the intake camshaft 22. This rotates the vane rotor 34 integrally with the intake camshaft 22. Vanes 36 extend from the vane rotor 34.

The intake timing pulley 24*a*, which is arranged on the end of the intake camshaft 22 and rotatable relative to the intake camshaft 22, has a plurality of outer teeth 24*b*. An end plate 38, a housing body 40, and a cover 42, which define a housing, are fastened to the intake timing pulley 24*a* by a bolt 44 to rotate integrally with the intake timing pulley 24*a*. The cover 42 covers the housing body 40 with the vane rotor 34 accommodated therein. A plurality of projections 46 project from the inner wall of the housing body 40.

A bore 48 extends in the axial direction of the intake camshaft 22 in one of the vanes 36. A movable lock pin 50 is accommodated in the bore 48. The lock pin 50 has a hole 50*a* in which a spring 54 is retained to urge the lock pin 50 toward the end plate 38. A socket 52 is provided in the end plate 38. When the lock pin 50 is aligned with the socket 52, the spring 54 forces the lock pin 73 to enter the socket 52. In this state, the end plate 38 and the vane rotor 34 are locked to each other such that their relative positions are fixed. This prohibits relative rotation between the housing body 40 and the vane rotor 34 and rotates the intake camshaft 22 integrally with the intake timing pulley 24*a*.

An oil groove 56 extends along the front surface of the vane rotor 34. The oil groove 56 connects the lock pin bore 48 with an arcuate opening 58, which extends through the cover 42. The oil groove 56 and the arcuate opening 58 function to externally discharge air or oil that resides between the cover 42 and the lock pin 50 in the bore 48.

Figure 4:
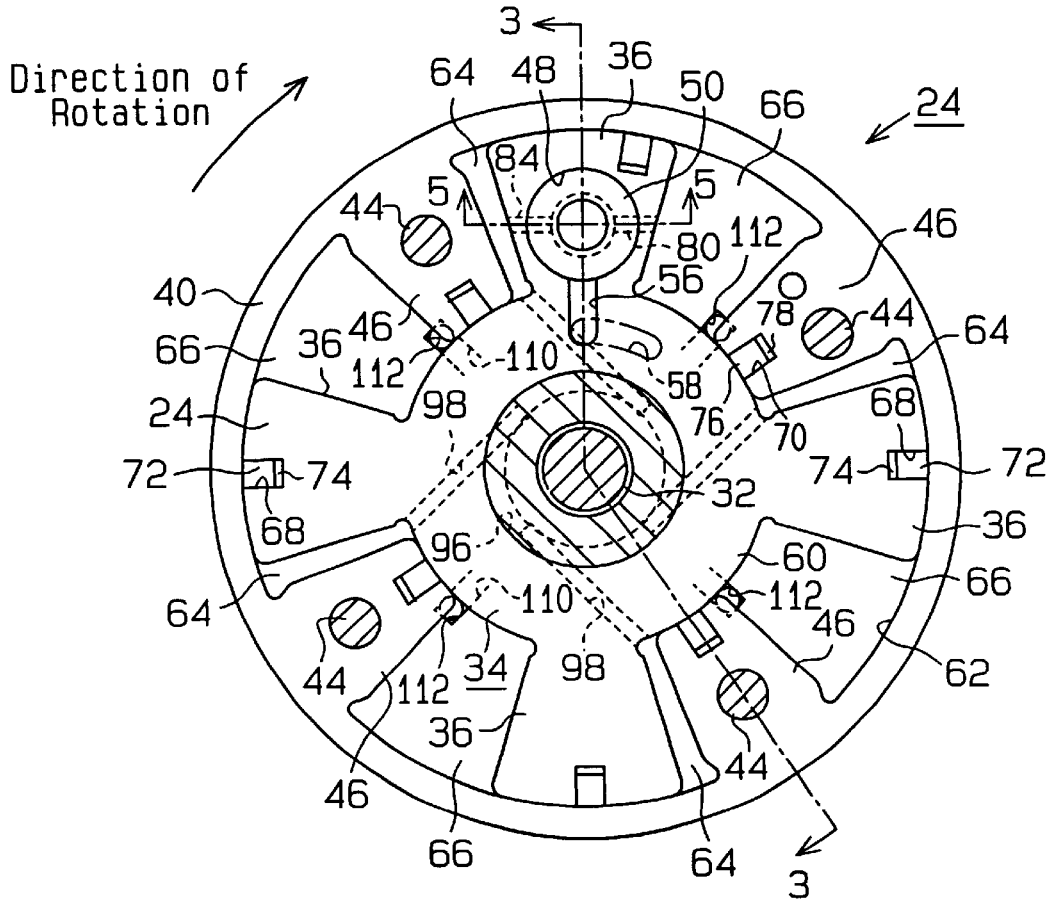
FIG. 4 is an end view showing the interior of the first actuator.

As shown in FIG. 4, a cylindrical hub 60 is provided at the central portion of the vane rotor 34. Equally spaced vanes 36 extend radially from the hub 60. For example, four vanes 36, spaced 90 degrees apart from one another, extend from the hub 60 in the preferred and illustrated embodiment.

Four projections 46, equally spaced like the vanes 36, project from the inner wall of the housing body 40. A cavity 62 is defined between each pair of adjacent projections 46. One of the vanes 36 extends into each cavity 62. Each vane 36 contacts the inner wall of the housing body 40 in the associated cavity 62. Each projection 46 contacts the cylindrical surface of the hub 60. A first pressure chamber 64 is defined on one side of the vane 36 and a second pressure chamber 66 is defined on the other side of the vane 36 in each cavity 62. The vanes 36 are movable between the associated pair of projections 46. Therefore, contact between the vanes 36 and the associated projections 46 restricts the rotation of the vane rotor 34 relative to the housing body 40 between two positions. In other words, rotation of the vane rotor 34 relative to the housing body 40 is restricted to a range defined between the two positions.

The arrow in FIG. 4 shows the rotating direction of the intake timing pulley 24*a*. Each second pressure chamber 66 is located on the leading side of the associated vane 36, while each first pressure chamber 64 is located on the trailing side of the associated vane 36. The rotating direction corresponds to an advancement direction for advancing the valve timing. The direction opposite of the rotating direction corresponds to a retardation direction for retarding the valve timing. Hydraulic oil is forced into the first pressure chambers 64 to advance the valve timing, while hydraulic oil is forced into the second pressure chambers 66 to retard the valve timing.

A vane groove 68 extends in the axial direction along the outer surface of each vane 36. Likewise, a projection groove 70 extends along the inner surface of each projection 46. A seal member 72 and a leaf spring 74 for urging the seal member 72 radially outward are arranged in each vane groove 68. In the same manner, a seal member 76 and a leaf spring 78 for urging the seal member 76 radially inward are arranged in each projection groove 70.

Figure 5:
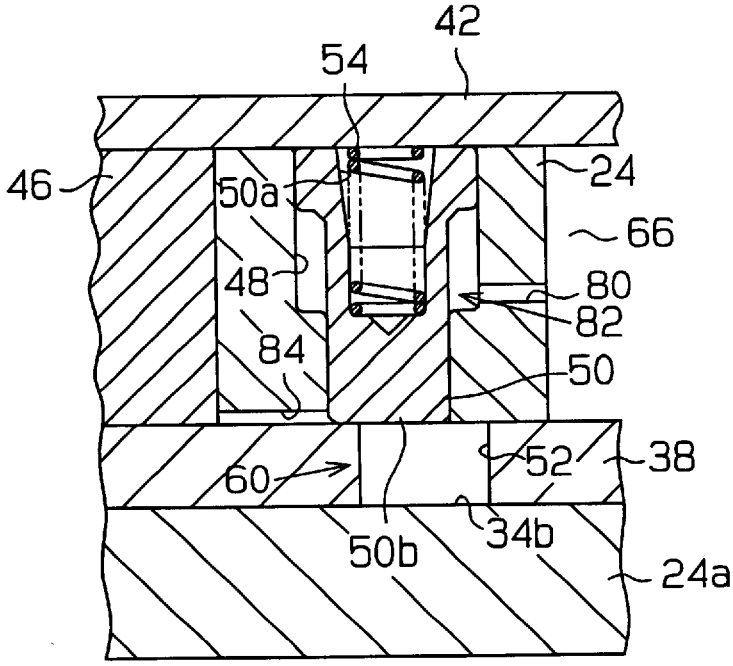
FIG. 5 is a partial cross-sectional view taken along line 5—5 in FIG. 4.

The operation of the lock pin 50 will now be described with reference to FIGS. 5 and 6. FIG. 5 shows the vane rotor 34 at the most retarded position, in which each vane 36 is abutted against the associated retarding side projection 46. In this state, the lock pin 50 is misaligned with the socket 50.

That is, the distal end 50*b* of the lock pin 50 is located outside of the socket 52.

The hydraulic pressure in the first pressure chambers 64 is null or insufficient when starting the engine 11 or before an electronic control unit (ECU) 180 commences hydraulic pressure control. In this state, cranking of the engine 11 produces counter torque, which rotates the vane rotor 34 relative to the housing body 40 in the advancement direction. Thus, the lock pin 50 is moved until it aligns and enters the socket 52 as shown in FIG. 6. This prohibits relative rotation between the vane rotor 34 and the housing body 40. In other words, the vane rotor 34 and the housing body 40 rotate integrally with each other during cranking.

Figure 6:
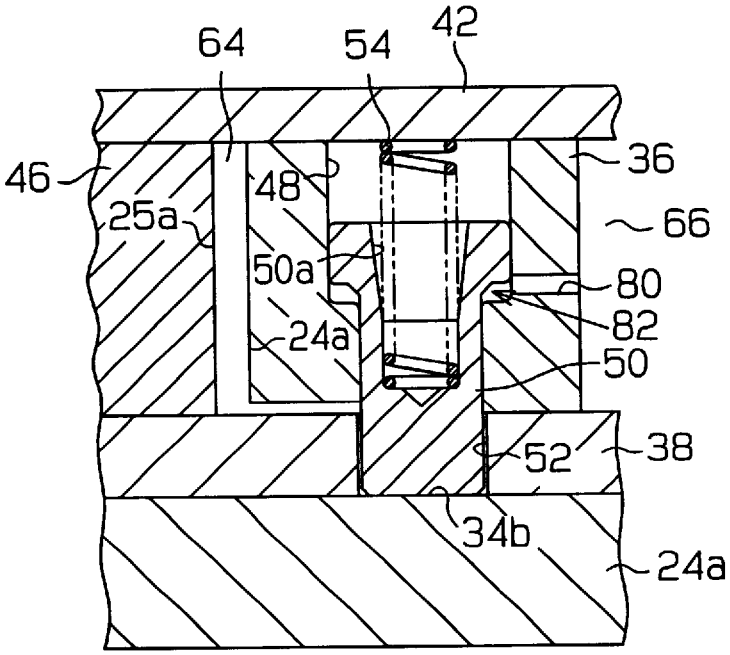
FIG. 6 is a partial cross-sectional view showing the lock pin of FIG. 5 in an actuated state.
Figure 7:
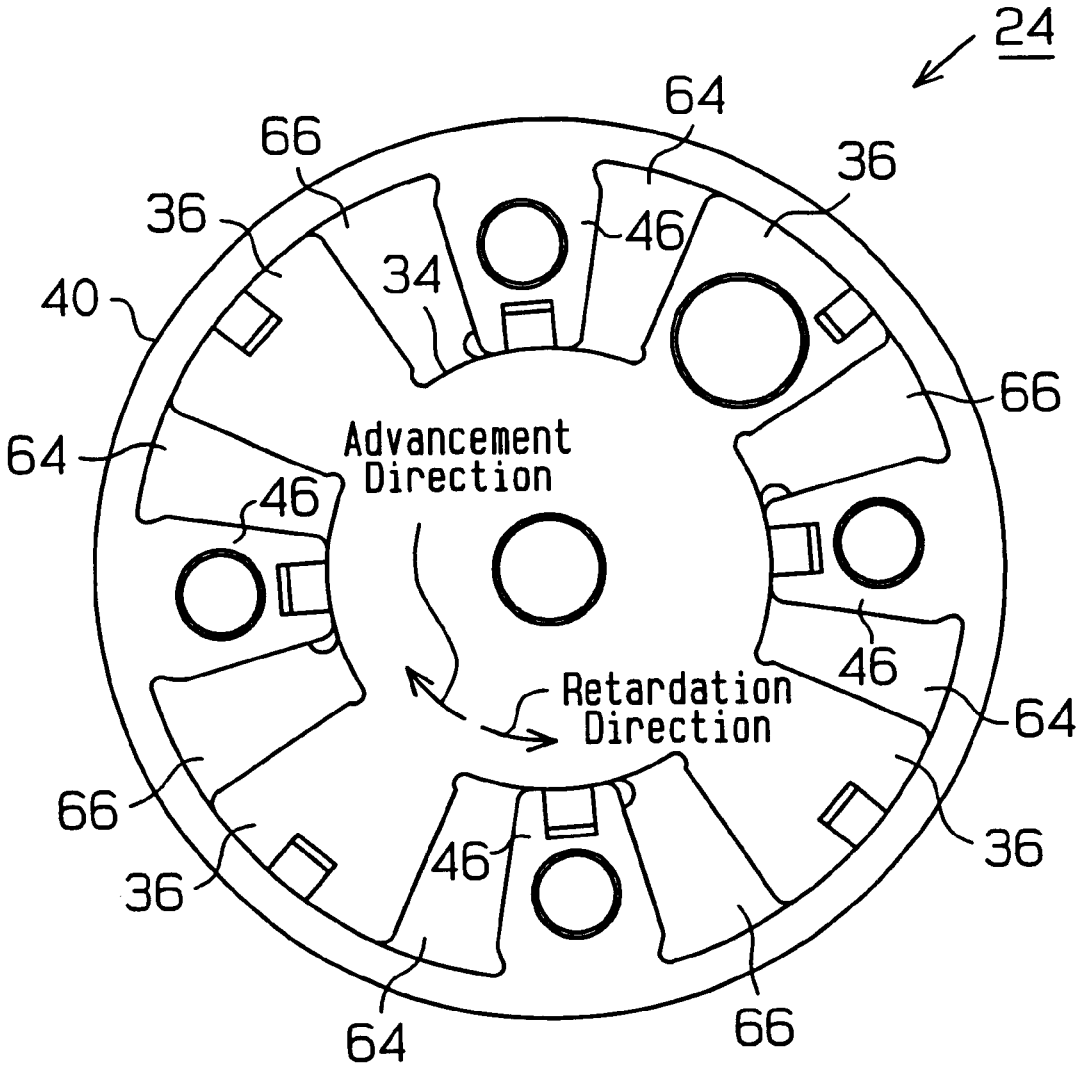
FIG. 7 is an end view like FIG. 4 showing the vane rotor of the first actuator of FIG. 4 in a rotated state.

As shown in FIGS. 5 and 6, an oil conduit 80 extends through the vane 36 from the associated second pressure chamber 66 to an annular space 82 defined in the bore 48. The hydraulic pressure in the annular space 82 is increased through the oil conduit 80 to move the lock pin 50 out of the socket 52 against the urging force of the spring 54 to release the lock pin 50. A further oil conduit 84 extends through the vane 36 from the associated first pressure chamber 64 to provide the socket 52 with hydraulic pressure when the lock pin 50 is released from the socket 52. This maintains the lock pin 50 in the released state. Relative rotation between the housing body 40 and the vane rotor 34 is permitted when the lock pin 50 is released. In this state, the rotational phase of the vane rotor 34 relative to the housing body 40 is adjusted in accordance with the hydraulic pressure of the first and second pressure chambers 64, 66.

A structure for delivering hydraulic oil to the first and second pressure chambers 64, 66 will now be described with reference to FIG. 3. A first oil conduit 86 and a second oil conduit 86 extend through the cylinder head 14. The first oil conduit 86 is connected to an oil conduit 94, which extends through the intake camshaft 22, by an oil groove 90, which extends along the peripheral surface of the intake camshaft 22, and an oil hole 92, which extends through the journal 22*a*. The oil conduit 94 leads into an annular space 96 defined in the vane rotor hub 60. Four oil conduits 98 extend radially from the annular space 96. Each oil conduit 98 is connected to one of the first chambers 64. Thus, the hydraulic oil delivered to the annular space 96 is sent into the first pressure chambers 64 through the associated oil conduits 98.

The second oil conduit 88 is connected with an oil groove 100, which extends along the peripheral surface of the intake camshaft 22. The intake camshaft 22 has an oil hole 102, an oil conduit 104, and oil hole 106, and an oil groove 108. The oil groove 108 is connected with oil notches 110, which are formed in the end face of the intake timing pulley 24*a*. As shown in FIGS. 3 and 4, four oil holes 112 extend through the end plate 38 to open at a location near the projections 46, respectively. Each oil hole 112 is connected with one of the oil notches 110 and leads into a corresponding second pressure chamber 66. Thus, the hydraulic oil in the oil notches 110 is delivered to the second pressure chamber 66 through the oil hole 112.

The first oil conduit 86, the oil groove 90, the oil hole 92, the oil conduit 94, the annular space 96, and the oil holes 98 define a first oil passage P1 for delivering hydraulic oil to the first pressure chambers 64. The second oil conduit 88, the oil groove 102, the oil conduit 104, the oil hole 106, the oil groove 108, the oil notches 110, and the oil holes 112 define a second oil passage P2 for delivering hydraulic oil to the second pressure chambers 66. The ECU 180 drives a first oil control valve 114 to control the flows of hydraulic oil to and the pressures of the first and second pressure chambers 64, 66 through the associated first and second oil passages P1, P2.

The vane 36 that has the lock pin bore 48 has an oil conduit 84, as shown in FIGS. 4 and 5. The oil conduit 84 connects the associated first pressure chamber 64 with the socket 52 to communicate the hydraulic pressure of the first pressure chamber 64 to the socket 52.

An annular oil space 82 is also defined in the lock pin bore 48 between the lock pin 50 and the vane 36. As shown in FIGS. 4 and 5, the annular oil space 82 is connected to the associated second pressure chamber 66 through an oil conduit 80. Thus, the hydraulic pressure of the second pressure chamber 66 is communicated to the annular oil space 82.

The first oil control valve 114 includes a casing 116. The casing 116 has a first supply/discharge port 118, a second supply/discharge port 120, a first discharge port 122, a second discharge port 124, and a supply port 126. The first supply/discharge port 118 is connected to the first oil passage P1, while the second supply/discharge port 120 is connected to the second oil passage P2. The supply port 126 is connected to a supply channel 128, through which hydraulic oil is delivered by an oil pump P. The first and second discharge ports 122, 124 are connected to a discharge channel 130. A spool 138 having four valve elements 132 is accommodated in the casing 116. A coil spring 134 and an electromagnetic solenoid 136 urge the spool 138 in opposite directions, respectively.

When the electromagnetic solenoid 136 is de-excited, the spool 138 is moved to one side of the casing 116 (to the right side as viewed in FIG. 3) by the force of the coil spring 134. This connects the first supply/discharge port 118 to the first discharge port 122 and the second supply/discharge port 120 to the supply port 126. In this state, the hydraulic oil contained in the oil pan 13*a*is sent to the second pressure chambers 66 through the supply channel 128, the first oil control valve 114, and the second oil passage P2. In addition, the hydraulic oil in the first pressure chambers 64 is returned to the oil pan 13*a* through the first oil passage P1, the first oil control valve 114, and the discharge channel 130. As a result, the vane rotor 34 and the intake camshaft 22 rotate relative to the timing pulley 24*a* in a direction opposite to the rotating direction of the timing pulley 24*a*. Thus, the intake camshaft 22 is retarded.

When the electromagnetic solenoid 136 is excited, the spool 138 is moved to the other side of the casing 116 (to the left side as viewed in FIG. 3), countering the force of the coil spring 134. This connects the second supply/discharge port 120 to the second discharge port 124 and the first supply/discharge port 118 to the supply port 126. In this state, the hydraulic oil contained in the oil pan 13*a* is sent to the first pressure chambers 64 through the supply channel 128, the first oil control valve 114, and the first oil passage P1. In addition, the hydraulic oil in the second pressure chambers 66 is returned to the oil pan 13*a*through the second oil passage P1, the first oil control valve 114, and the discharge channel 130. As a result, the vane rotor 34 and the intake camshaft 22 rotate relative to the timing pulley 24*a* in the rotating direction of the timing pulley 24*a*. Thus, the intake camshaft 22 is advanced. For example, the intake camshaft 22 may be advanced from the state shown in FIG. 4 to the state shown in FIG. 7.

By further controlling the current fed to the electromagnetic solenoid 136 to arrange the spool 138 at an intermediate position in the casing 116, the first and second supply/discharge ports 118, 120 are closed. Thus, the flow of hydraulic oil through each supply/discharge port 118, 120 is prohibited. In this state, hydraulic oil is neither supplied to nor discharged from the first and second pressure chambers 64, 66. This holds the hydraulic oil residing in each pressure chamber 64, 65. Thus, the intake camshaft 22 is rotated by the crankshaft 15 with the vane rotor 34 and the intake camshaft 22 locked to each other in a fixed relationship, for example, in the position shown in FIG. 4 or that of FIG. 7.

The intake camshaft 22 is normally retarded to retard the valve timing of the intake valves 20 when the engine 11 is running in a low speed range and when the engine 11 is running in a high speed range with a high load applied. This stabilizes operation of the engine 11 by decreasing the valve overlap (the time during which the intake valves 20 and exhaust valves 21 are both opened) when the engine 11 is running in the low speed range. Retardation of the closing timing of the intake valves 20 when the engine 11 is running in a high speed range with a high load applied improves the intake efficiency of the air-fuel mixture drawn into each combustion chamber 17. Furthermore, the intake camshaft 22 is normally advanced to advance the valve timing of the intake valves 20 when the engine 11 is running in a low or intermediate load state. Advancement of the valve timing of the intake valves 20 increases the valve overlap and reduces pumping loss, which in turn, improves fuel efficiency.

Figure 8:
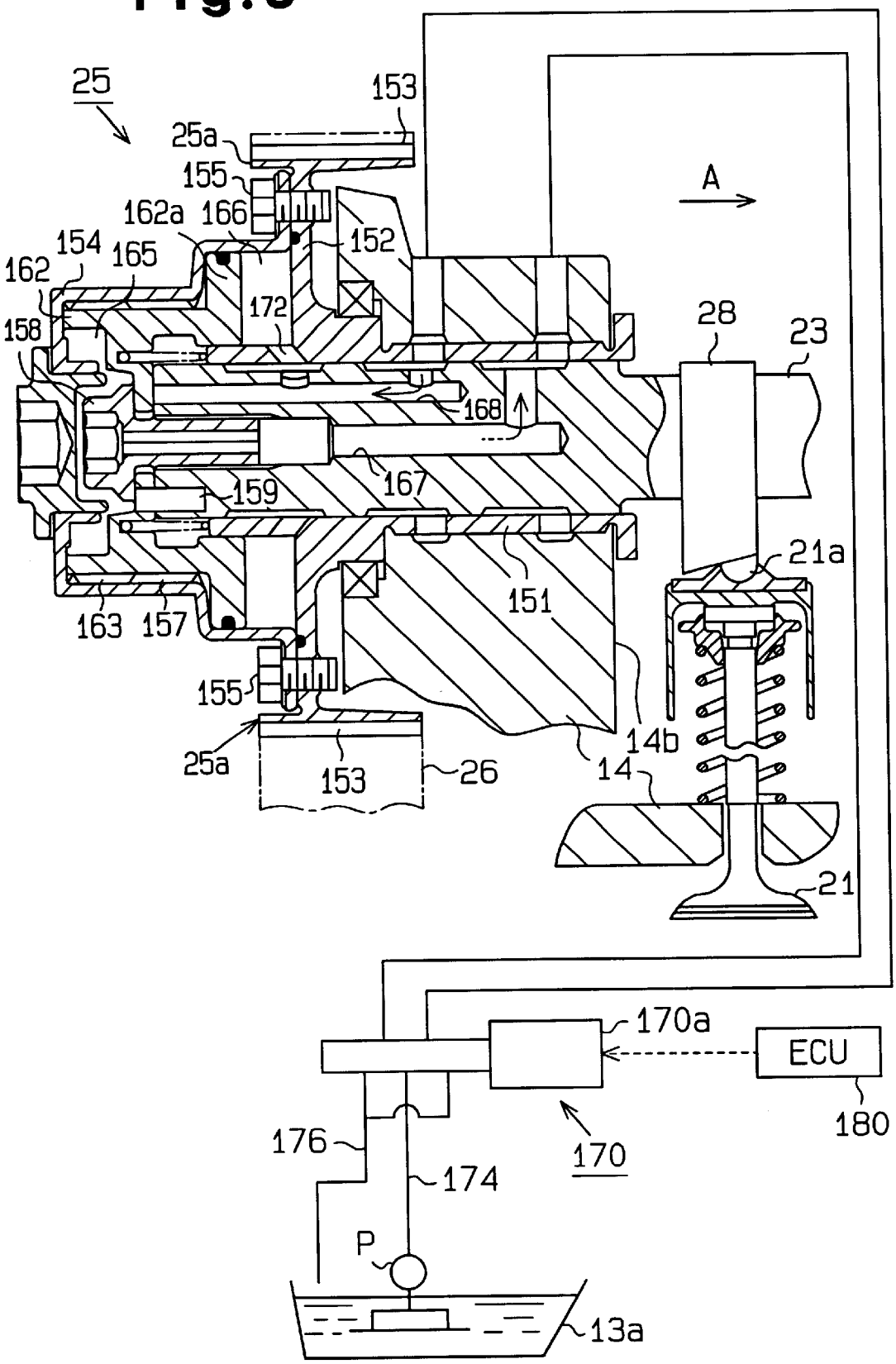
FIG. 8 is a schematic cross-sectional view showing a second actuator incorporated in the variable valve timing apparatus of FIG. 1.

The second actuator 25 and its hydraulic drive structure will now be described in detail with reference to FIG. 8. As shown in FIG. 8, the second actuator 25 includes the exhaust timing pulley 25*a*. The exhaust timing pulley 25 has a sleeve 151, through which the exhaust camshaft 23 extends, a circular plate 152 extending from the peripheral surface of the sleeve 151, and outer teeth 153 extending from the periphery of the circular plate 152. The bearing 14*a* of the cylinder head 14 rotatably supports the sleeve 151 of the exhaust timing pulley 25*a*. The exhaust camshaft 23 is supported such that it slides axially through the sleeve 151.

A pulley cover 154 is fastened to the exhaust timing pulley 25*a* by bolts 155. Straight inner teeth 157 extending in the axial direction of the exhaust camshaft 23 are arranged along the inner surface of the pulley cover 154 in association with the end portion of the exhaust camshaft 23.

A hollow ring gear 162 is fastened to the end of the exhaust camshaft 23 by a hollow bolt 158 and a pin 159. Straight teeth 163, which mesh with the inner teeth 157 of the pulley cover 154, extend along the peripheral surface of the ring gear 162. The straight teeth 163 extend in the axial direction of the exhaust camshaft 23. Therefore, the ring gear 162 moves in the axial direction of the exhaust camshaft 23 together with the exhaust camshaft 23.

In the second actuator 25, when the engine 11 rotates the crankshaft 15, the rotation of the crankshaft 15 is transmitted to the exhaust timing pulley 25*a* by the timing belt 26. This rotates the exhaust camshaft 23 integrally with the exhaust timing pulley 25*a* and drives the exhaust valves 21.

Movement of the ring gear 162 toward the exhaust timing pulley 25*a* (in the direction indicated by arrow A in FIG. 8) integrally moves the exhaust camshaft 23 in the same direction. Each exhaust valve 21 has a cam follower 21*a* that follows the profile of the associated three-dimensional cam 28. When the exhaust camshaft 23 moves in the direction of arrow A, contact between each exhaust cam 28 and the cam follower 21*a* of the associated exhaust valve 21 increases the lift amount and the opening duration of the exhaust valve 21. In other words, the opening timing of the exhaust valves 21 is advanced, and the closing timing of the exhaust valves 21 is retarded.

Movement of the ring gear 162 toward the pulley cover 154 (in the direction opposite to that indicated by arrow A in FIG. 8) integrally moves the exhaust camshaft 23 in the same direction. This causes contact between each exhaust cam 28 and the cam follower 21*a* of the associated exhaust valve 21 that decreases the lift amount and the opening duration of the exhaust valve 21. In other words, the opening timing of the exhaust valves 21 is retarded, and the closing timing of the exhaust valves 21 is advanced.

The structure in the second actuator 25 for controlling the movement of the ring gear 162 will now be described. The ring gear 162 has a flange 162*a*. The peripheral surface of the flange 162 slides axially along the inner wall of the pulley cover 154 during movement of the ring gear 162. Additionally, the flange 162 serves as a partition to separate a first oil chamber 165 from a second oil chamber 166 in the pulley cover 154. A first control conduit 167, which is connected to the first oil chamber 165, and a second control conduit 168, which is connected to the second oil chamber 166, extends through the exhaust camshaft 23.

The first control conduit 167 is connected to the first oil chamber 165 through the interior of the hollow bolt 158. Further, the first control conduit 167 is connected to a second oil control valve 170 through a channel extending through the cylinder head 14. The second control conduit 168 is connected to the second oil chamber 166 through an oil conduit 172 extending through the sleeve 151 of the exhaust timing pulley 25*a*. Further, the second control conduit 168 is connected to the second oil control valve 170 through another channel extending through the cylinder head 14.

A supply channel 174 and a discharge channel 176 are connected to the second oil control valve 170. The supply channel 174 is connected to the oil pan 13*a* by way of the oil pump P, which is also used by the first actuator 24. The discharge channel 176 is directly connected to the oil pan 13*a*.

The second oil control valve 170 has a structure similar to that of the first oil control valve 114. More specifically, the second oil control valve 170 includes an electromagnetic solenoid 170*a* and ports. When the electromagnetic solenoid 170*a* is excited, the ports are connected to deliver the hydraulic oil in the oil pan 13*a* to the second oil chamber 166 through the supply channel 174, the second oil control valve 170, and the second control conduit 168. In addition, the hydraulic oil in the first oil chamber 165 is returned to the oil pan 13*a* through the first control conduit 167, the second oil control valve 170, and the discharge channel 176. As a result, the ring gear 162 is moved toward the first oil chamber 165 to decrease the lift amount and opening duration of the exhaust valves 21. FIG. 8 shows a minimum lift amount state.

When the electromagnetic solenoid 170*a* is de-excited, the ports are connected to deliver the hydraulic oil in the oil pan 13*a* to the first oil chamber 165 through the supply channel 174, the second oil control valve 170, and the first control conduit 167. In addition, the hydraulic oil in the second oil chamber 166 is returned to the oil pan 13*a*through the second control conduit 168, the second oil control valve 170, and the discharge channel 176. As a result, the ring gear 162 is moved toward the second oil chamber 166 to increase the lift amount and opening duration of the exhaust valves 21.

By further controlling the current fed to the electromagnetic solenoid 170*a* to prohibit the flow of hydraulic oil between the ports, hydraulic oil is neither supplied to nor discharged from the first and second oil chambers 165, 166. This holds the hydraulic oil residing in each oil chamber 165, 166 and locks the ring gear 162. Thus, the axial position of the ring gear 162 is fixed. The lift amount and opening duration of the exhaust valves 21 remains constant as long as the ring gear 162 is locked.

As shown in FIG. 1, the first and second oil control valves 114, 170 are controlled by the ECU 180. The ECU 180 includes a central processing unit (CPU) 182, a read only memory (ROM) 183, a random access memory (RAM) 184, and a backup RAM 185.

The ROM 183 stores various types of control programs and maps. The maps are referred to during execution of the control programs. The CPU 182 executes the necessary computations based on the control programs stored in the ROM 183. The RAM 184 temporarily stores the results of the computations executed by the CPU 182 and data sent from various sensors. The backup RAM 185 is a non-volatile memory that keeps the necessary data stored when the engine 11 is not running. The CPU 182, the ROM 183, the RAM 184, and the backup RAM 185 are connected to one another by a bus 186. The bus 186 also connects the CPU 182, the ROM 183, the RAM 184, and the backup RAM 185 to an external input circuit 187 and an external output circuit 188.

The external input circuit 187 is connected to an engine speed sensor, an intake pressure sensor, a throttle sensor, and other sensors (these sensors are not shown in the drawings) employed to detect the operating state of the engine 11. The external input circuit 187 is also connected to a electromagnetic crankshaft pickup 190, an electromagnetic intake camshaft pickup 192, and an electromagnetic exhaust camshaft pickup 194. The crankshaft pickup 190 detects the rotational phase and rotating speed of the crankshaft 15. The intake camshaft pickup 192 detects the rotational phase and rotating speed of the intake camshaft 22. The exhaust camshaft pickup 194 detects the rotational phase, the rotating speed, and axial position of the exhaust camshaft 23. The external output circuit 188 is connected to the first and second oil control valves 114, 170.

In the first embodiment, the operation of the intake and exhaust valves 20, 21 is controlled by the ECU 180. More specifically, the ECU 180 controls the first oil control valve 114 when it is necessary to vary the valve timing of the intake valves 20. The first oil control valve 114 is controlled based on the signals sent from the sensors that detect the operating state of the engine 11. The ECU 180 also controls the second oil control valve 170 when the lift amount and opening duration of the exhaust valves 21 must be altered so that the engine 11 runs in an optimal manner.

The ECU 180 receives signals from the crankshaft pickup 190, the intake camshaft pickup 192, and the exhaust camshaft pickup 194 to control the first and second oil control valves 114, 170. The ECU 180 obtains the rotational phase of the intake camshaft 22 relative to the crankshaft 15 based on these signals. Afterward, the ECU 180 feedback controls the first actuator 24 with the first oil control valve 114 to change the rotational phase of the intake camshaft 22 so that the valve timing of the intake valves 20 is varied to a target timing. The ECU 180 also obtains the axial position of the exhaust camshaft 23. Afterward, the ECU 180 feedback controls the second actuator 25 with the second oil control valve 170 to adjust the lift amount and opening duration of the exhaust valves 21 to a target lift amount and target opening duration.

The advantages of the first embodiment will now be described. In the variable valve timing apparatus 10 according to the first embodiment, the first actuator 24, which adjusts the rotational phase of the intake camshaft 22 relative to the crankshaft 15, is incorporated in the intake timing pulley 24*a*. Furthermore, the second actuator 25, which adjusts the lift amount of the exhaust valves 21 with three-dimensional cams, is incorporated in the exhaust timing pulley 25*a*. In other words, the first and second actuators 24, 25 are arranged on different, separate camshafts. Thus, the camshaft need not be elongated. This avoids the enlargement of the engine 11. Accordingly, the engine 11 is installed in an engine compartment without occupying more space than a prior art engine.

Further, the valve overlap of the intake and exhaust valves 20, 21 and the closing timing of the intake valves 20 are controlled in the same manner and without the additional limitations that result when the first and second actuators 24, 25 are incorporated on the same camshaft. For example, the closing timing of the intake valves 20 is varied by the first actuator 24, which is arranged on the intake camshaft 22, in accordance with the operating state of the engine 11. The valve overlap is also adjusted by cooperation between the first actuator 24 and the second actuator 25, which is arranged on the exhaust camshaft 23, in accordance with the operating state of the engine 11.

Additionally, since the two actuators 24, 25 are arranged on different shafts, neither the intake camshaft 22 or the exhaust camshaft 23 is required to support more than one actuator. Therefore, neither shaft is excessively heavy. Thus, the occurrence of problems concerning the durability of the journals supporting the shafts are avoided.

Figure 9:
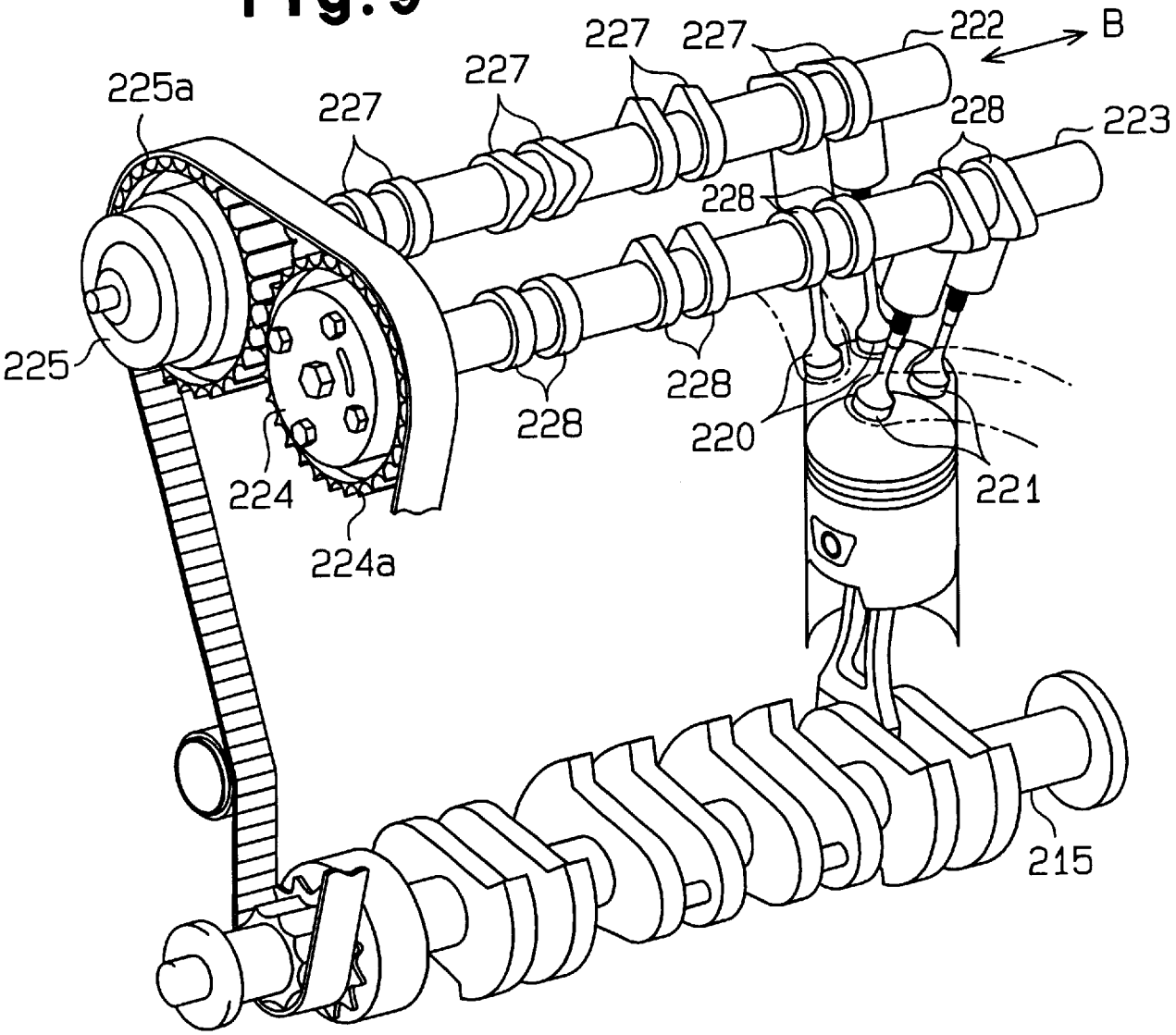
FIG. 9 is a partial perspective view showing an engine employing a variable valve timing apparatus according to a second embodiment of the present invention.

A second embodiment according to the present invention will now be described with reference to FIG. 9. The second embodiment differs from the first embodiment in that a lift adjustor, or second actuator 225, is incorporated in a timing pulley 225*a* of an intake camshaft 222 to adjust the lift amount of intake valves 220. Furthermore, a phase adjustor, or first actuator 224, is incorporated in a timing pulley 224*a* of an exhaust camshaft 223 to change the rotational phase of the exhaust camshaft 223 relative to a crankshaft 215. The intake camshaft 222, which extends through a cylinder head, is supported such that it is rotatable and axially movable (in the directions indicated by arrow B). The intake camshaft 222 includes three-dimensional cams, or intake cams 227. The exhaust camshaft 223 is supported such that it is rotatable, though axially fixed, in the cylinder head. Normal exhaust cams 228 are arranged along the exhaust camshaft 223. That is, the profiles of the exhaust cams 228 do not vary in the axial direction of the exhaust camshaft 223. The crankshaft 215 is identical to that employed in the first embodiment.

The axial position of the intake camshaft 222 is controlled by a second oil control valve to adjust the lift amount and opening duration of the intake valves 220 in accordance with the operating state of the engine. The rotational phase of the exhaust camshaft 223 relative to the crankshaft 215 is controlled by a first oil control valve to vary the valve timing of the exhaust valves 221 in accordance with the operating state of the engine.

The second embodiment has the same advantages as the first embodiment. The cooperation between the first actuator 224, which is arranged on the exhaust camshaft 223, and the second actuator 225, which is arranged on the intake camshaft 222, adjusts the valve overlap. Furthermore, the second actuator 225 varies the closing timing of the intake valves 220.

Figure 10:
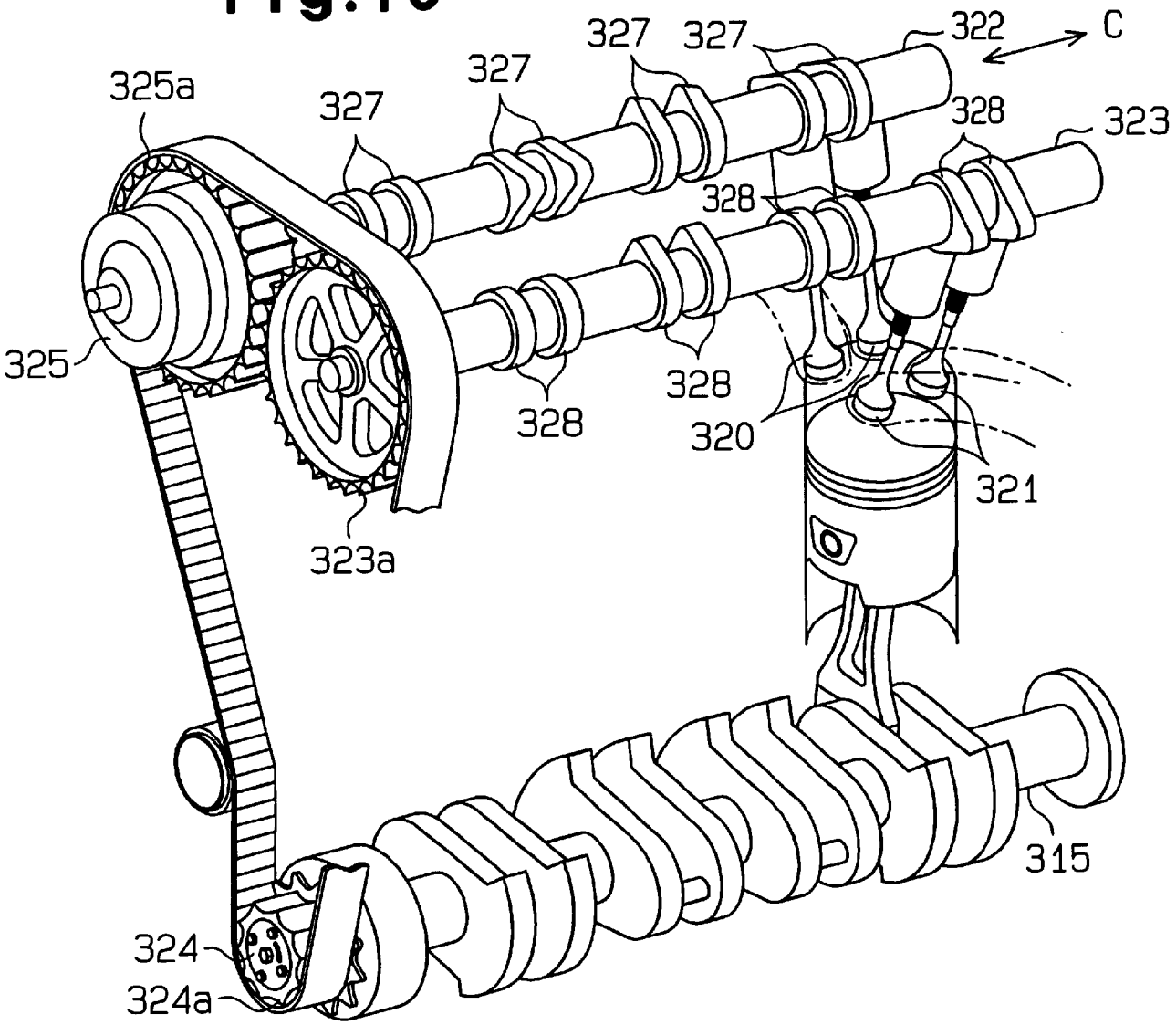
FIG. 10 is a partial perspective view showing an engine employing a variable valve timing apparatus according to a third embodiment of the present invention.

A third embodiment according to the present invention will now be described with reference to FIG. 10. The third embodiment differs from the first embodiment in that neither a first actuator nor a second actuator is incorporated in a timing pulley 323*a* of an exhaust camshaft 323. A phase adjustor, or first actuator 324, is incorporated in a timing pulley 324*a* of a crankshaft 315. A lift adjustor, or second actuator 325, is incorporated in a timing pulley 325*a* of an intake camshaft 322.

The intake camshaft 322, which extends through a cylinder head, is supported such that it is rotatable and axially movable (in the directions indicated by arrow C). The intake camshaft 322 includes three-dimensional intake cams 327. The exhaust camshaft 323 is supported such that it is rotatable, though axially fixed, in the cylinder head. Normal exhaust cams 328 are arranged along the exhaust camshaft 323. That is, the profiles of the exhaust cams 328 do not vary in the axial direction of the exhaust camshaft 323. The crankshaft 315 is supported such that it is rotatable, though axially fixed.

The axial position of the intake camshaft 322 is controlled by a second oil control valve to adjust the lift amount and opening duration of the intake valves 320 in accordance with the operating state of the engine. The rotational phase of the crankshaft 315 relative to the intake camshaft 322 and the exhaust camshaft 323 is controlled by a first oil control valve to vary the valve timing of the intake and exhaust valves 320, 321 in accordance with the operating state of the engine.

The third embodiment has the same advantages as the first embodiment. Additionally, the cooperation between the first actuator 324, which is incorporated in the crank timing pulley 324*a*, and the second actuator 325, which is incorporated in the intake timing pulley 324*a*, varies the closing timing of the intake valves 320 and the valve overlap.

Figure 11:
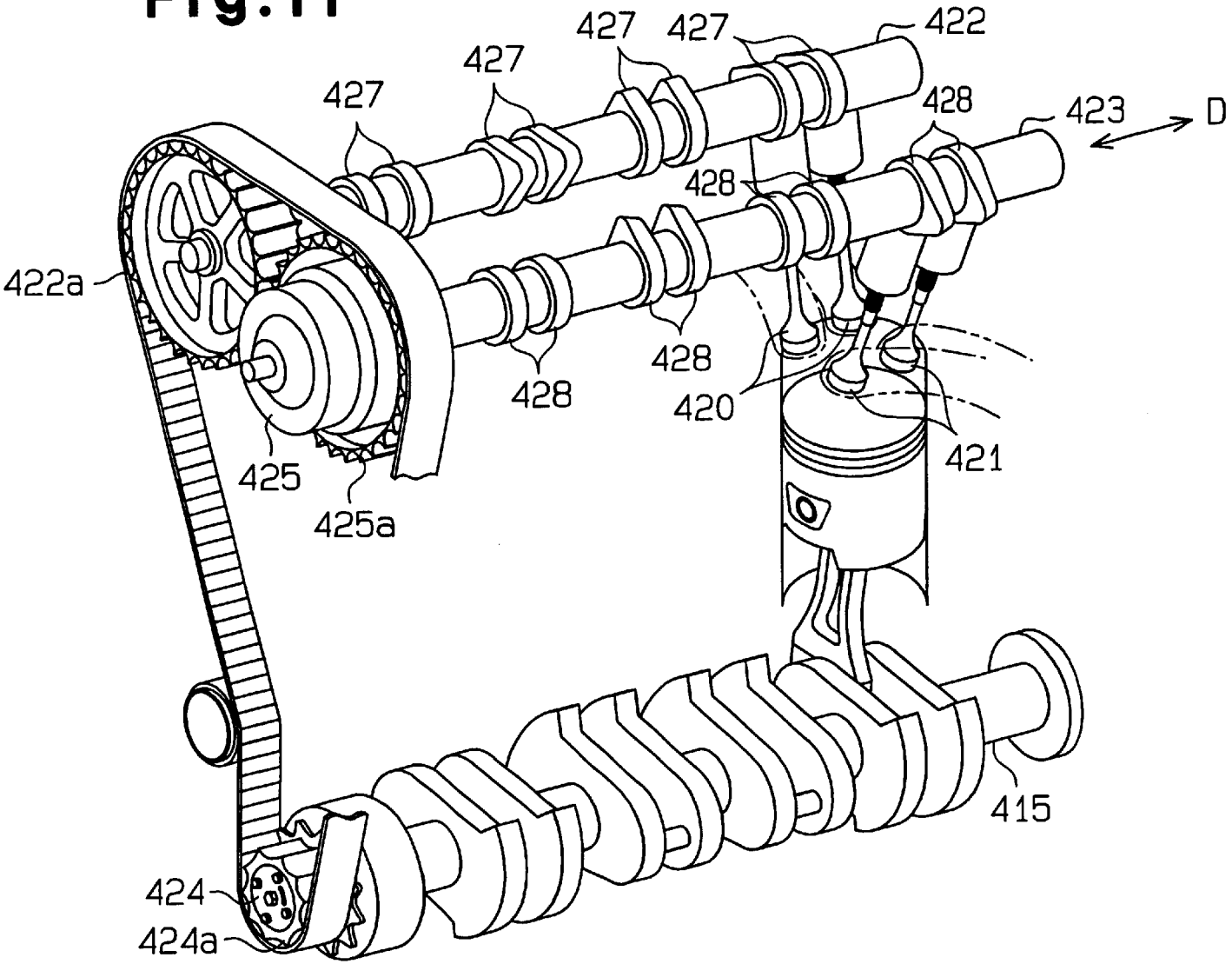
FIG. 11 is a partial perspective view showing an engine employing a variable valve timing apparatus according to a fourth embodiment of the present invention.

A fourth embodiment according to the present invention will now be described with reference to FIG. 11. The fourth embodiment differs from the first embodiment in that neither a first actuator nor a second actuator is incorporated in a timing pulley 422 of an intake camshaft 422. A phase adjustor, or first actuator 424, is incorporated in a timing pulley 424*a* of a crankshaft 415. In the same manner as the first embodiment, a lift adjustor, or second actuator 425, is incorporated in a timing pulley 425*a* of an exhaust camshaft 422, which has three-dimensional cams 428. Like the first embodiment, the profiles of the intake cams 427 do not vary in the axial direction of the intake camshaft 422.

The axial position of the exhaust camshaft 423 (the movement indicated by arrow D) is controlled by a second oil control valve to adjust the lift amount and opening duration of exhaust valves 421 in accordance with the operating state of the engine. The rotational phase of the crankshaft 415 relative to the intake camshaft 422 and the exhaust camshaft 423 is controlled by a first oil control valve to vary the valve timing of the intake and exhaust valves 420, 421 in accordance with the operating state of the engine.

The fourth embodiment has the same advantages as the first embodiment. Additionally, the first actuator 424 arranged on the crankshaft 415 varies the closing timing of the intake valves 420. The cooperation between the first actuator 424 and the second actuator 425, which is arranged on the exhaust camshaft 423, changes the valve overlap.

Figure 12:
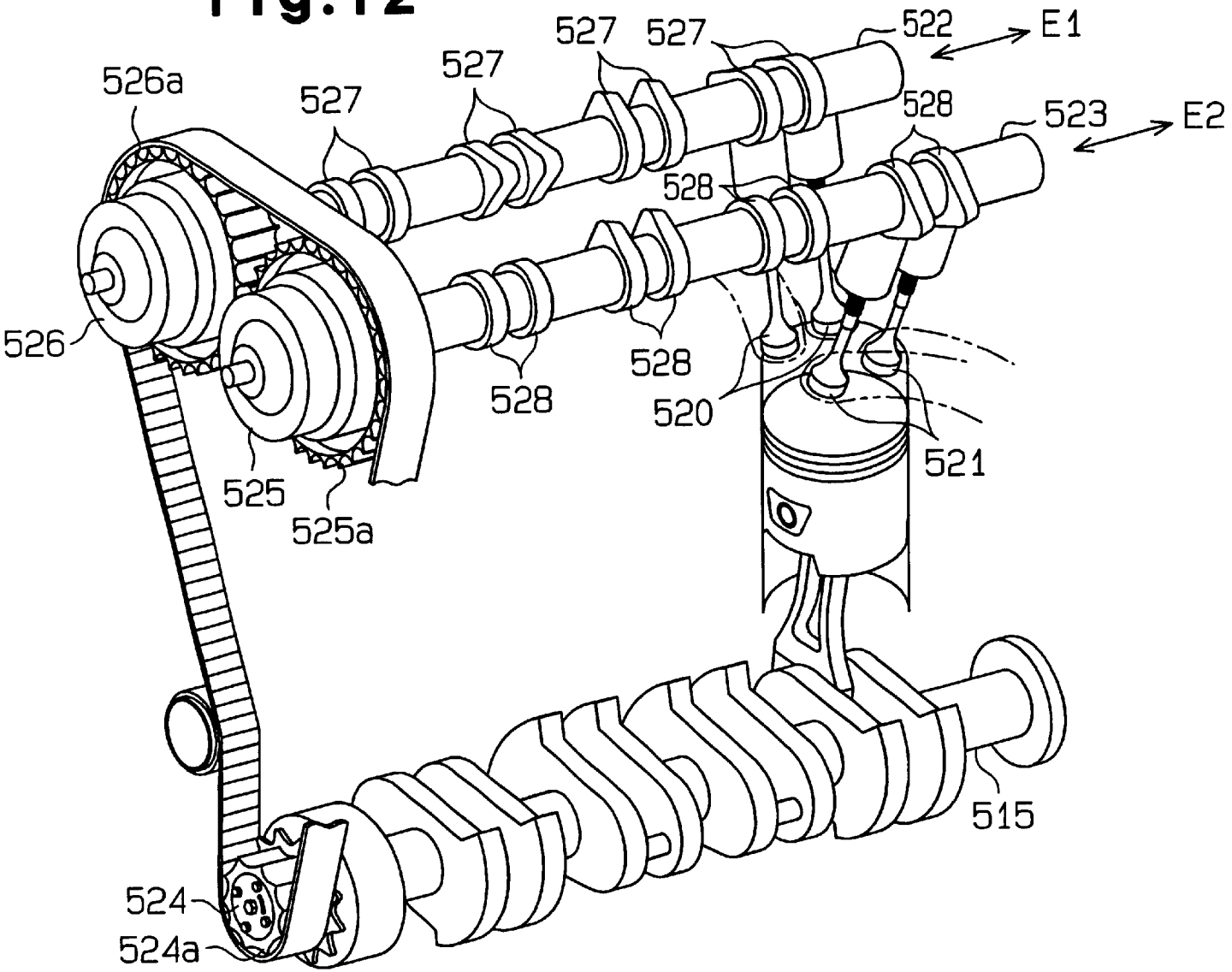
FIG. 12 is a partial perspective view showing an engine employing a variable valve timing apparatus according to a fifth embodiment of the present invention.

A fifth embodiment according to the present invention will now be described with reference to FIG. 12. The fifth embodiment differs from the first embodiment in that a lift adjustor, or second actuator 526 is incorporated in a timing pulley 526*a* of an intake camshaft 522. The intake camshaft 522 has three-dimensional cams 527, and is rotatable and axially movable (in the directions indicated by arrow El). In addition, a phase adjustor, or first actuator 524, is incorporated in a timing pulley 524*a* of a crankshaft 515. A further second actuator 525, like that of the first embodiment, is incorporated in a timing pulley 525*a* of an exhaust camshaft 523, which has three-dimensional cams 528.

The axial position of the exhaust camshaft 523 (the movement indicated by arrow E2) is controlled by a second oil control valve to adjust the lift amount and opening duration of exhaust valves 521 in accordance with the operating state of the engine. Furthermore, the axial position of the intake camshaft 522 is controlled by another second oil control valve to adjust the lift amount and opening duration of intake valves 520 in accordance with the operating state of the engine.

The rotational phase of the crankshaft 515 relative to the intake camshaft 522 and the exhaust camshaft 523 is controlled by a first oil control valve to vary the valve timing of the intake and exhaust valves 520, 521 in accordance with the operating state of the engine.

The fifth embodiment has the same advantages as the first embodiment. Additionally, the cooperation between the first actuator 524, which is incorporated in the crank timing pulley 524*a*, and the two second actuators 525, 526, which are incorporated in the intake and exhaust timing pulleys 525*a*, 526*a*, adjusts the valve overlap and varies the closing timing of the intake valves 420.

Figure 13:
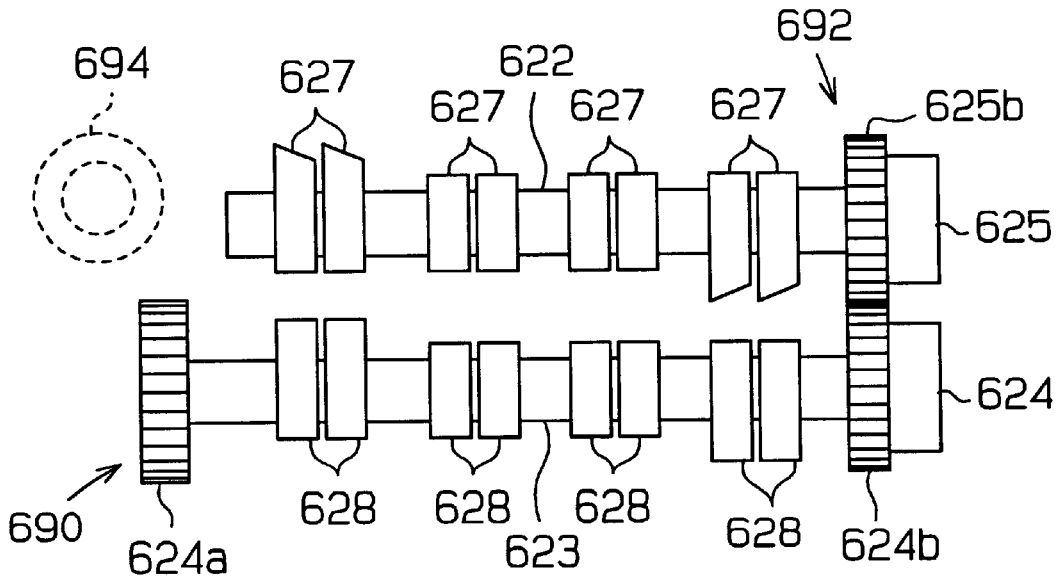
FIG. 13 is a schematic plan view showing an engine employing a variable valve timing apparatus according to a sixth embodiment of the present invention.

A sixth embodiment according to the present invention will now be described with reference to FIG. 13. This embodiment employs a crankshaft identical to that of the first embodiment.

An intake camshaft 622, an exhaust camshaft 623, and a crankshaft (not shown) are arranged parallel to one another. A first transmission train 690 is arranged at the left ends of the shafts (as viewed in FIG. 13). The first transmission train 690 includes a timing pulley (not shown) coupled to the crankshaft, an exhaust timing pulley 624*a* coupled to the exhaust camshaft 623, and a timing belt (not shown) connecting the crank timing pulley and the exhaust timing pulley 624*a*. The torque of the crankshaft, which is applied to the crank timing pulley, is directly transmitted to the exhaust timing pulley 624*a* by the timing belt, but is not directly transmitted to the intake camshaft 622.

A second transmission train 692 is arranged at the right ends of the shafts 622, 623. The second transmission train 692 includes an intake gear 625*b*, which is coupled to the intake camshaft 622, and an exhaust gear 624*b*, which is coupled to the exhaust camshaft 623. The exhaust and intake gears 624*b*, 625*b* mesh with each other. Thus, torque is directly transmitted from the exhaust camshaft 623 to the intake camshaft 622 by the second transmission train 692.

A phase adjustor, or first actuator 624, is incorporated in the exhaust gear 624*b* of the second transmission train 692. A lift adjustor, or second actuator 625, is incorporated in the intake gear 625*b* of the second transmission train 692. The structures of the first and second actuators 624, 625 are the same as that of the first embodiment.

The intake camshaft 622 has three-dimensional cams 627, and is rotatable and axially movable in a cylinder head. The exhaust camshaft 623 is supported such that it is rotatable, though axially fixed. Normal exhaust cams 628 are arranged along the exhaust camshaft 623. That is, the profiles of the exhaust cams 628 do not vary in the axial direction of the exhaust camshaft 623.

The sixth embodiment has the same advantages as the first embodiment. Additionally, since the first and second actuators 624, 625 are arranged on ends of the intake and exhaust camshafts 623, 622, respectively, and the first transmission gear 690 is arranged on the other end, the length of the engine can be shortened. Thus, the sixth embodiment provides more layout space in the engine compartment, especially where the first transmission train 690 is located. This side is normally located near a suspension member 694, which includes a coil spring and a shock absorber. Accordingly, interference between the engine and parts such as the suspension member 694 is avoided.

Figure 14:
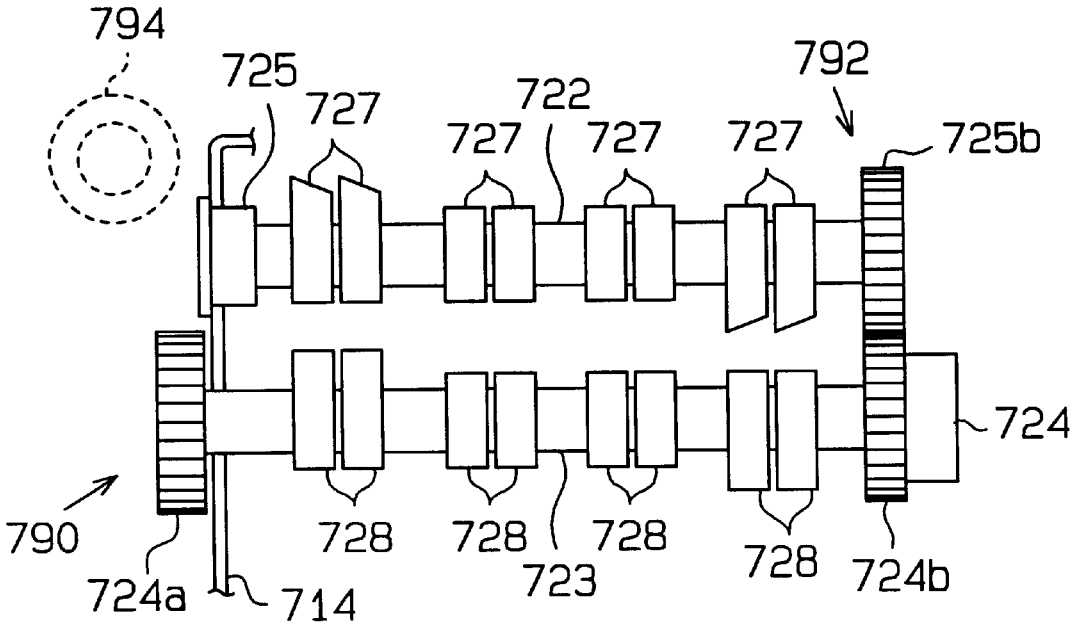
FIG. 14 is a schematic plan view showing an engine employing a variable valve timing apparatus according to a seventh embodiment of the present invention.

A seventh embodiment according to the present invention will now be described with reference to FIG. 14.

An intake camshaft 722, an exhaust camshaft 723, and a crankshaft (not shown) are arranged parallel to one another. A first transmission train 790 is arranged at the left ends of the shafts (as viewed in FIG. 14). The first transmission train 790 includes a timing pulley (not shown) coupled to the crankshaft, an exhaust timing pulley 724*a* coupled to the exhaust camshaft 723, and a timing belt (not shown) connecting the crank timing pulley and the exhaust timing pulley 724*a*. The torque of the crankshaft, which is applied to the crank timing pulley, is directly transmitted to the exhaust timing pulley 7*a* by the timing belt, but is not directly transmitted to the intake camshaft 722. A second transmission train 792 is arranged at the right ends of the shafts 722, 723. The second transmission train 792 includes an intake gear 725*b*, which is coupled to the intake camshaft 722, and an exhaust gear 724*b*, which is coupled to the exhaust camshaft 723. The exhaust and intake gears 724*b*, 725*b* mesh with each other. Thus, torque is directly transmitted from the exhaust camshaft 723 to the intake camshaft 722 by the second transmission train 792.

In the same manner as the sixth embodiment, a phase adjustor, or first actuator 724, is incorporated in the exhaust gear 724*b* of the second transmission train 792. The seventh embodiment differs from the sixth embodiment in that a lift adjustor, or second actuator 725, is arranged on the intake camshaft 722 on the end that is opposite to the second transmission train 792. The second actuator 725 is fixed to a cylinder head 714.

Figure 15:
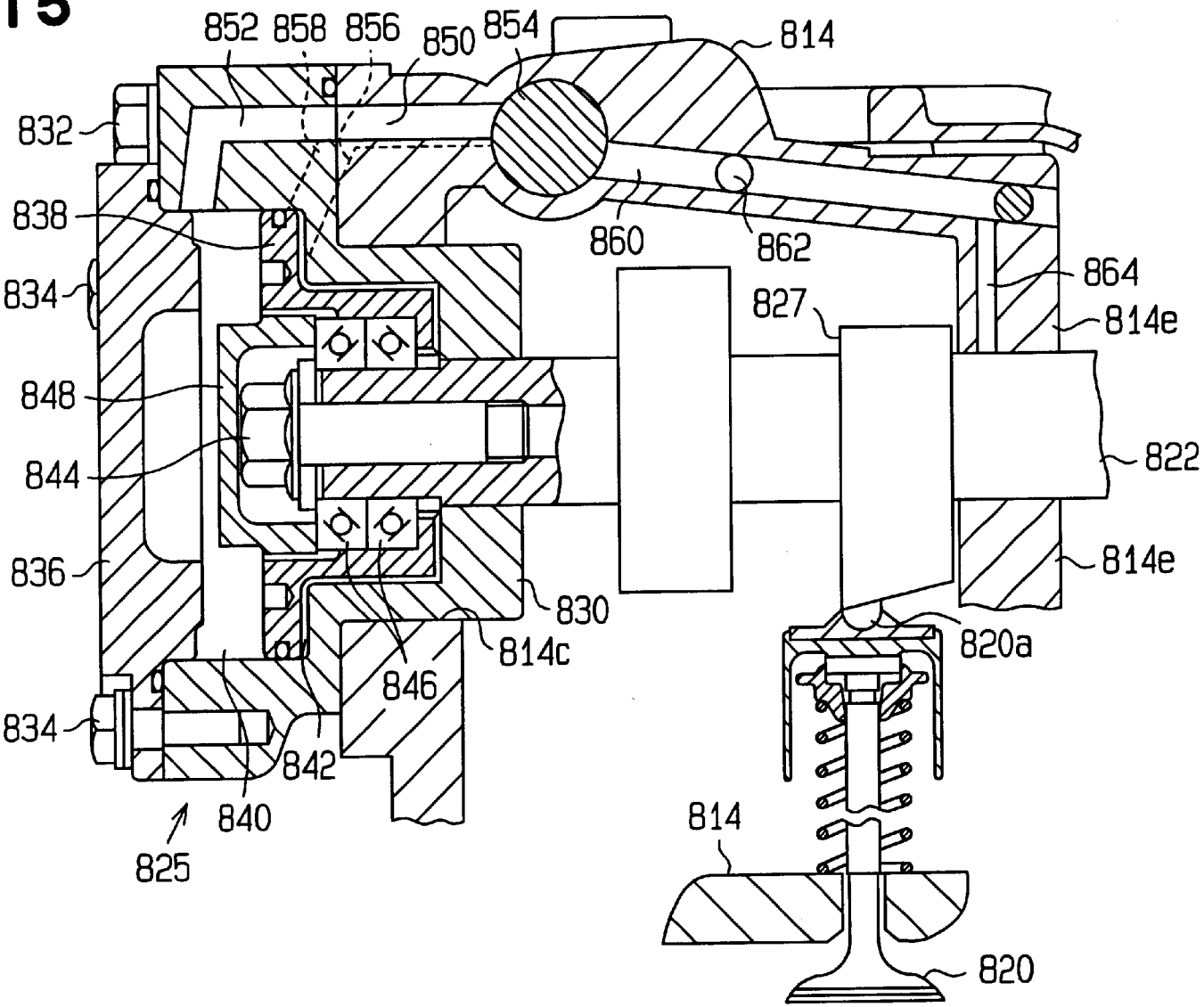
FIG. 15 is a partial cross-sectional view showing a second actuator incorporated in a variable valve timing apparatus according to an eighth embodiment of the present invention.

An eighth embodiment according to the present invention will now be described with reference to FIGS. 15 and 16. The structure of the variable valve timing apparatus is the same as the seventh embodiment of FIG. 14. However, the eighth embodiment employs a phase adjustor, or second actuator 825, that differs from that of the preceding embodiments.

The second actuator 825 has a housing 830. A cylinder head 814 has an opening 814*c* to receive the housing 830. Bolts 832 fasten the housing 830 to the cylinder head 814. The housing 830 has a hollow interior that is sealed by a cover 836. The cover 836 is fastened to the housing 830 by bolts 834.

A piston 838 is accommodated in the housing 830 and is movable in the axial direction of an intake camshaft 822. The piston 838 serves to partition the interior of the housing 830 into a first oil chamber 840 and a second oil chamber 842. An end of the intake camshaft 822 is rotatably supported by a bearing 846 in the central portion of the piston 833. A bolt 844 secures the end of the intake camshaft 822 to the piston 838. A cap 848 is screwed into the piston 838 to cover the bolt 844 and the bearing 846.

The hydraulic pressure in the first oil chamber 840 is controlled by a second oil control valve 854 through a control conduit 850, which extends through the cylinder head 814, and a control conduit 852, which extends through the housing 830. The hydraulic pressure in the second oil chamber 842 is controlled by the second oil control valve 854 through a control conduit 856, which extends through the cylinder head 814, and a control conduit 858, which extends through the housing 830.

An oil pump P supplies the second oil control valve 854 with hydraulic oil by way of supply channels 860, 862, which extend though the cylinder head 814. The cylinder head 814 has a bearing 814*e* to support the intake camshaft 822. The hydraulic oil is also supplied to the bearing 814e through an oil conduit 864, which extends through the bearing 814*e*. This lubricates the intake camshaft 822, which rotates and moves axially on the bearing 814*e*. A discharge channel connecting the second oil control valve 854 to an oil pan is not shown in FIG. 15.

The intake camshaft 822 has three-dimensional intake cams 827. Each intake cam 827 is arranged in association with an intake valve 820 having a cam follower 820*a*. When hydraulic oil is sent into the first oil chamber 840 by the second oil control valve 854 and hydraulic oil is forced out of the second oil chamber 842, the piston 838 moves axially toward the second oil chamber 842, as shown in FIG. 15. The intake camshaft 822 moves integrally with the piston 838. As a result, the cam followers 820*a*following the profiles of the associated intake cams 827 increase the lift amount and opening duration of the intake valves 820. This advances the opening timing and retards the closing timing of the intake valves 820.

Figure 16:
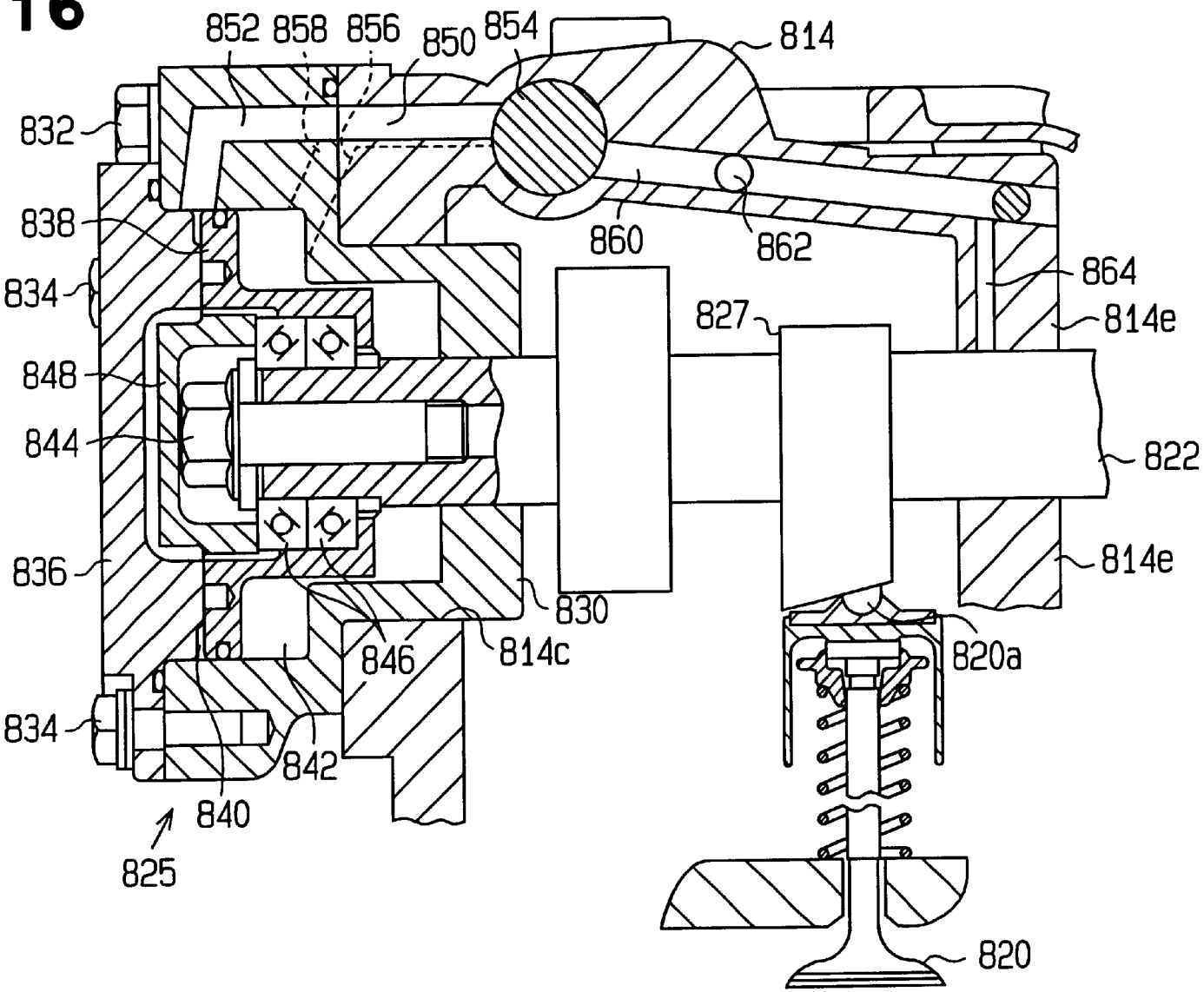
FIG. 16 is a view like FIG. 15 showing the second actuator of FIG. 15 in a state in which the amount of valve lift is decreased.

When hydraulic oil is sent into the second oil chamber 842 by the second oil control valve 854 and hydraulic oil is sent out of the first oil chamber 840, the piston 838 moves axially toward the first oil chamber 840, as shown in FIG. 16. As a result, the cam followers 820*a* following the profiles of the associated intake cams 827 decrease the lift amount and opening duration of the intake valves 820. This retards the opening timing and advances the closing timing of the intake valves 820.

The seventh and eighth embodiments have the same advantages as the first embodiment. Additionally, since the second actuator 725 (825) and the first transmission train 790 are arranged at one end of the intake and exhaust camshafts 722 (822), 723, while the first actuator 724 is arranged on the other end, the length of the engine can be shortened. Furthermore, the second actuator 725 (825) is independent from the first and second transmission trains 790, 792. Thus, the whole second actuator 725 (825) is substantially accommodated in the cylinder head 714, as shown in FIG. 14. This provides more layout space in the engine compartment, especially near the first transmission train 790. A suspension member 794 is normally located near the first transmission train 790. Accordingly, interference between the engine and parts such as the suspension member 794 is avoided.

A ninth embodiment according to the present invention will now be described with reference to FIG. 17. This embodiment differs from the above embodiments in that the first and second actuators are arranged on the same camshaft.

Figure 17:
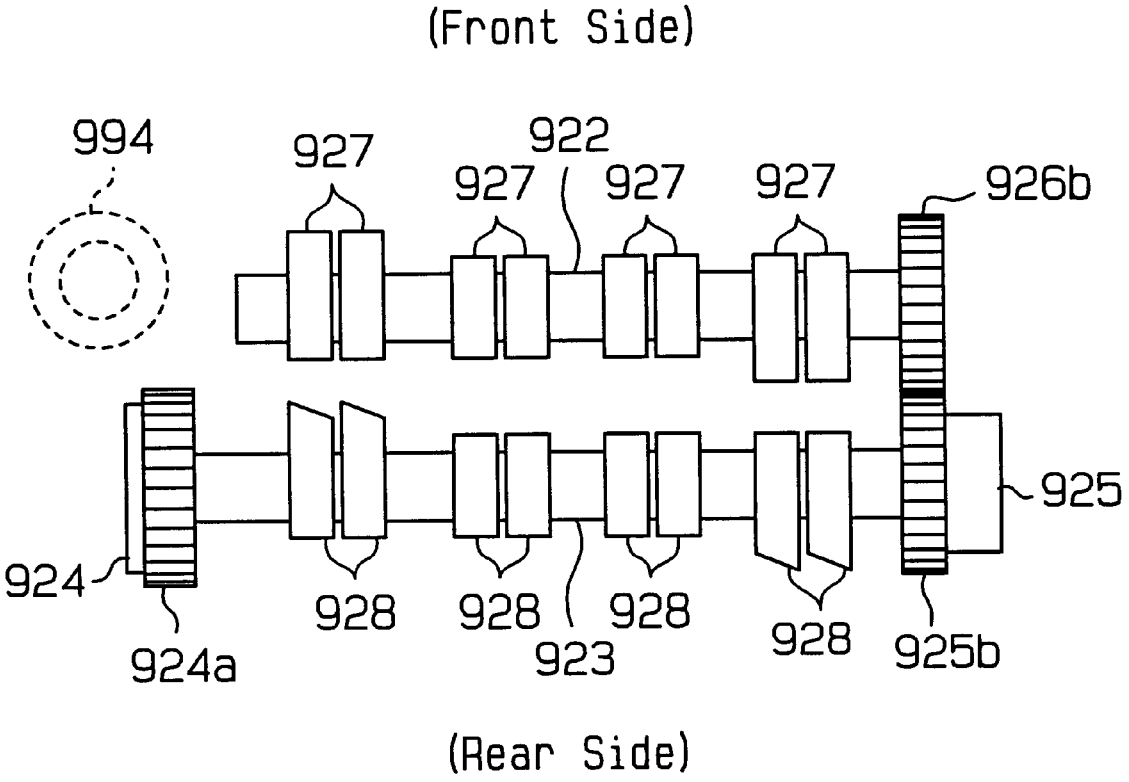
FIG. 17 is a schematic plan view showing a second actuator incorporated in a variable valve timing apparatus according to a ninth embodiment of the present invention.
Figure 18:
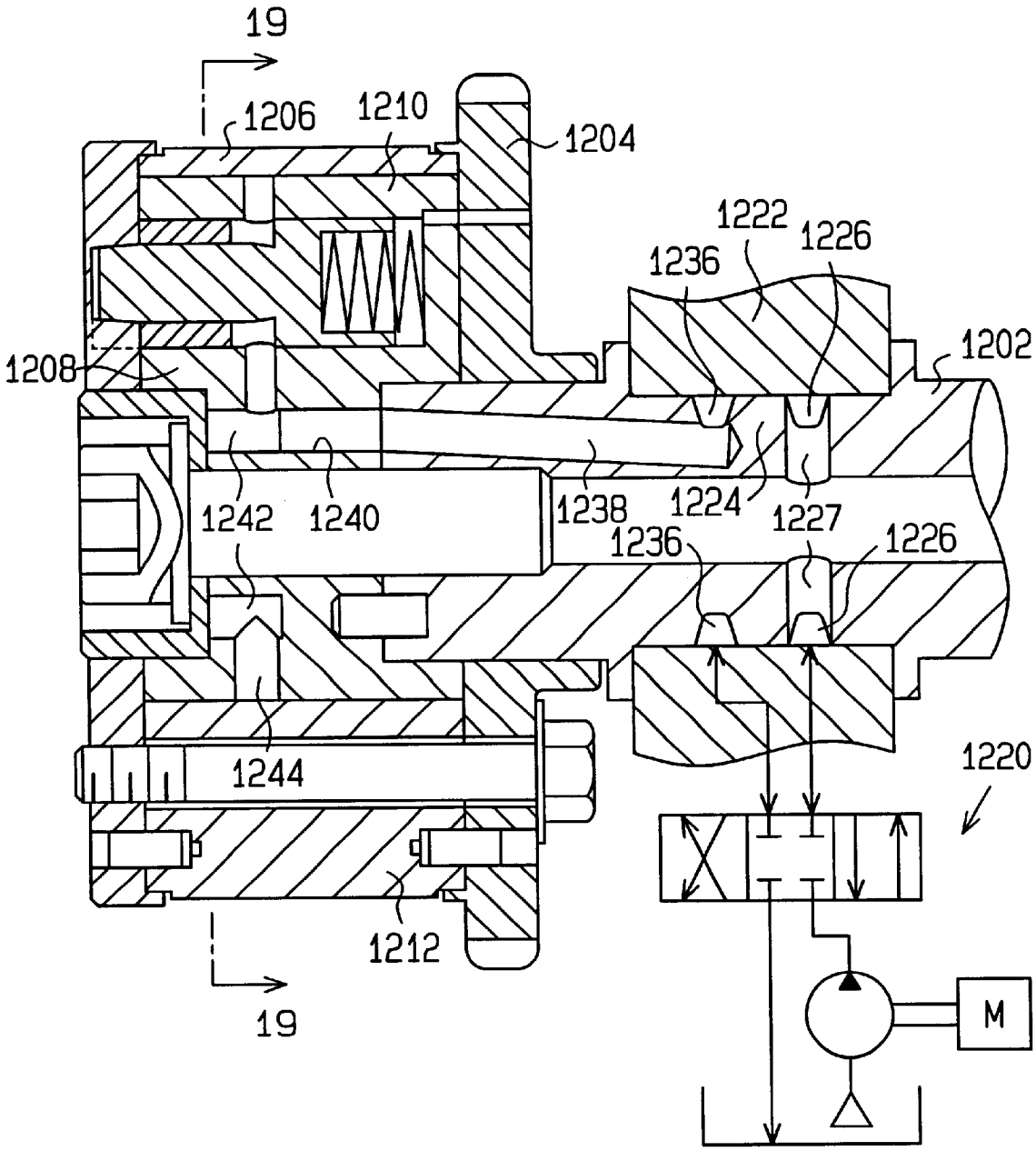
Fig.18 (Prior Art)
FIG. 18 is a schematic cross-sectional view showing a prior art variable valve timing apparatus that employs a first actuator.
Figure 19:
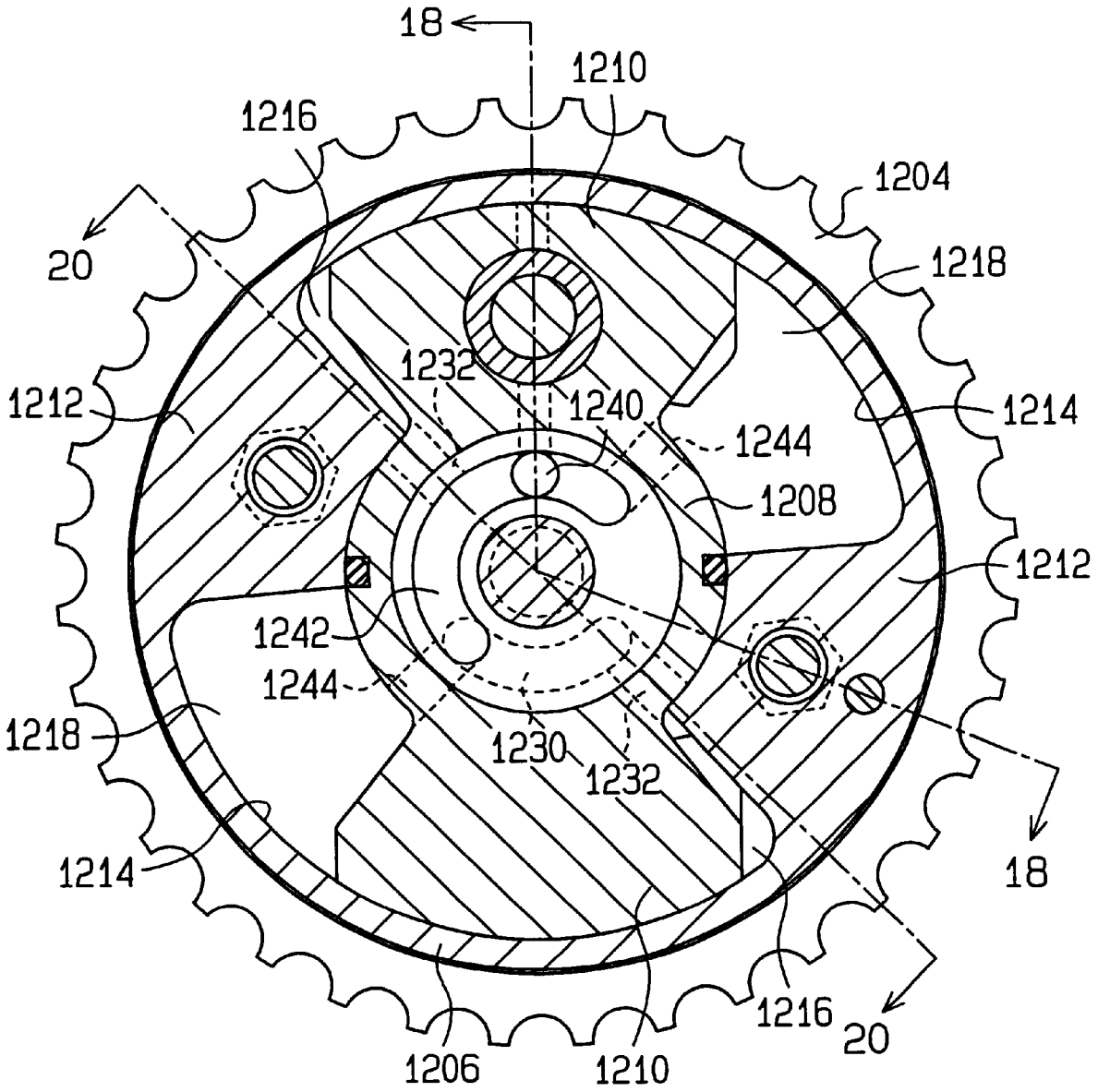
Fig.19 (Prior Art)
FIG. 19 is a cross-sectional view taken along line 19—19 in FIG. 18.
Figure 20:
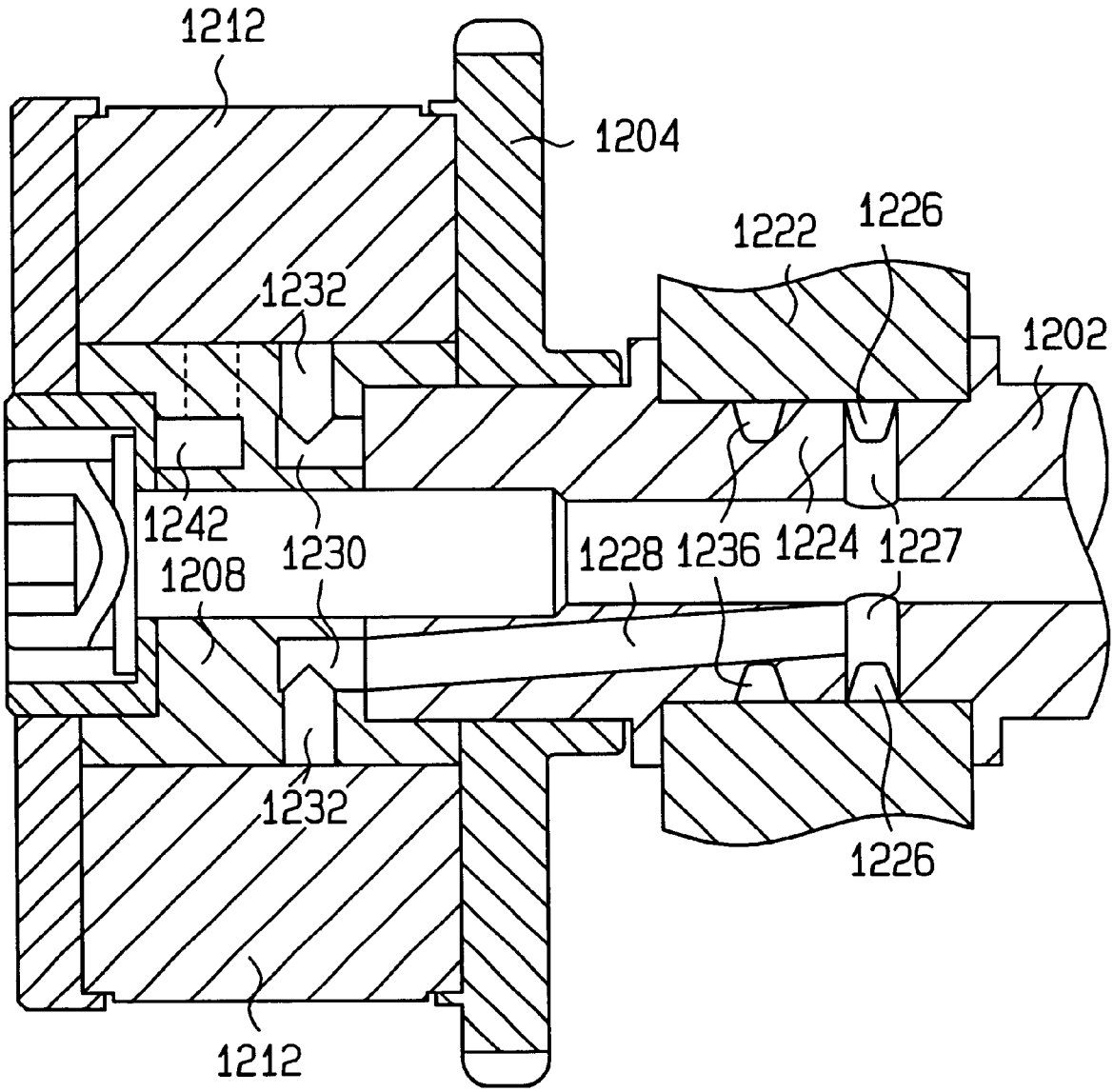
Fig.20 (Prior Art)
FIG. 20 is a partial cross-sectional view taken along line 20—20 in FIG. 11.
Figure 21:
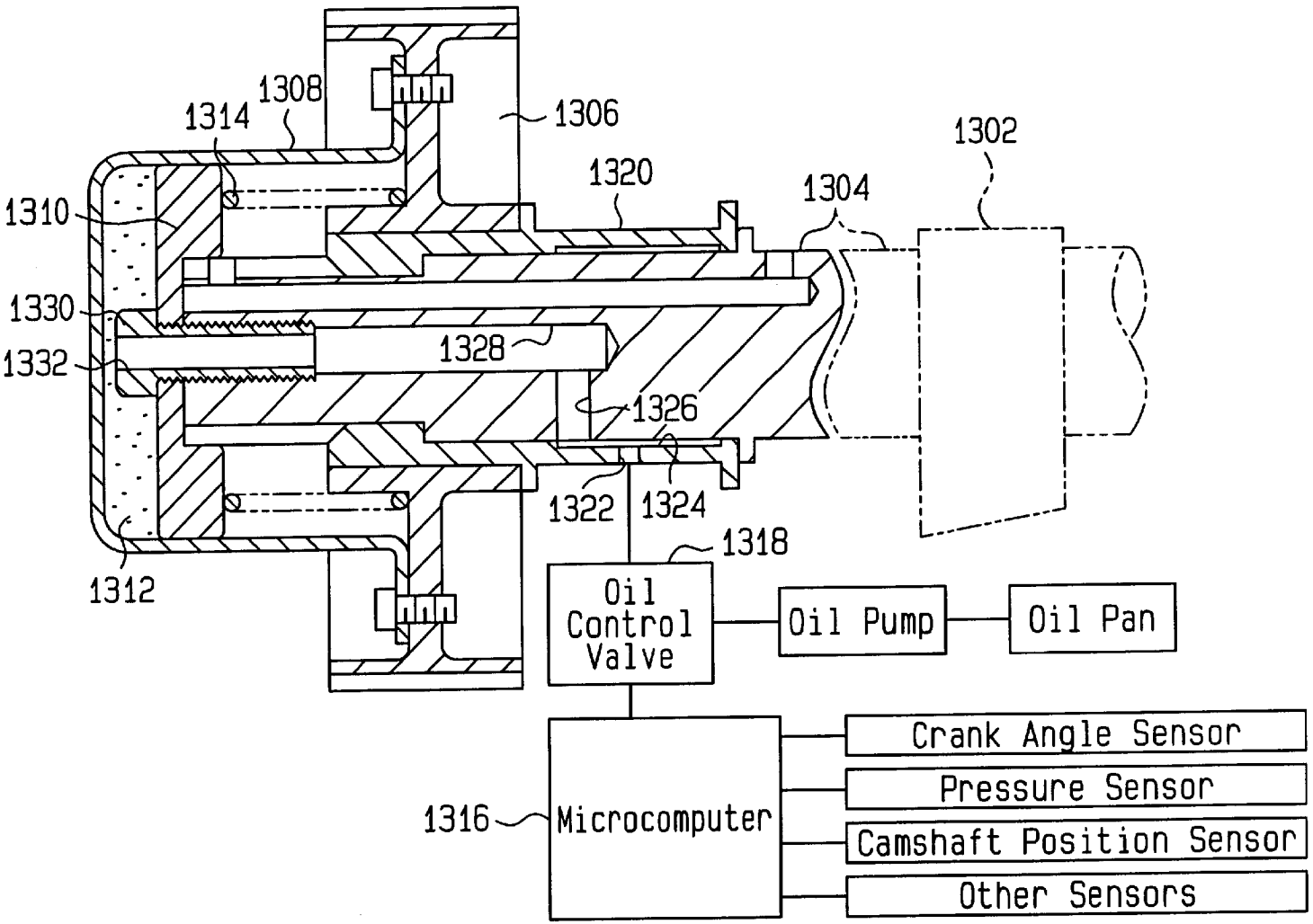
Fig.21 (Prior Art)
FIG. 21 is a partial cross-sectional view combined with a block diagram showing a second actuator employed in a prior art variable valve timing apparatus.
Figure 22:
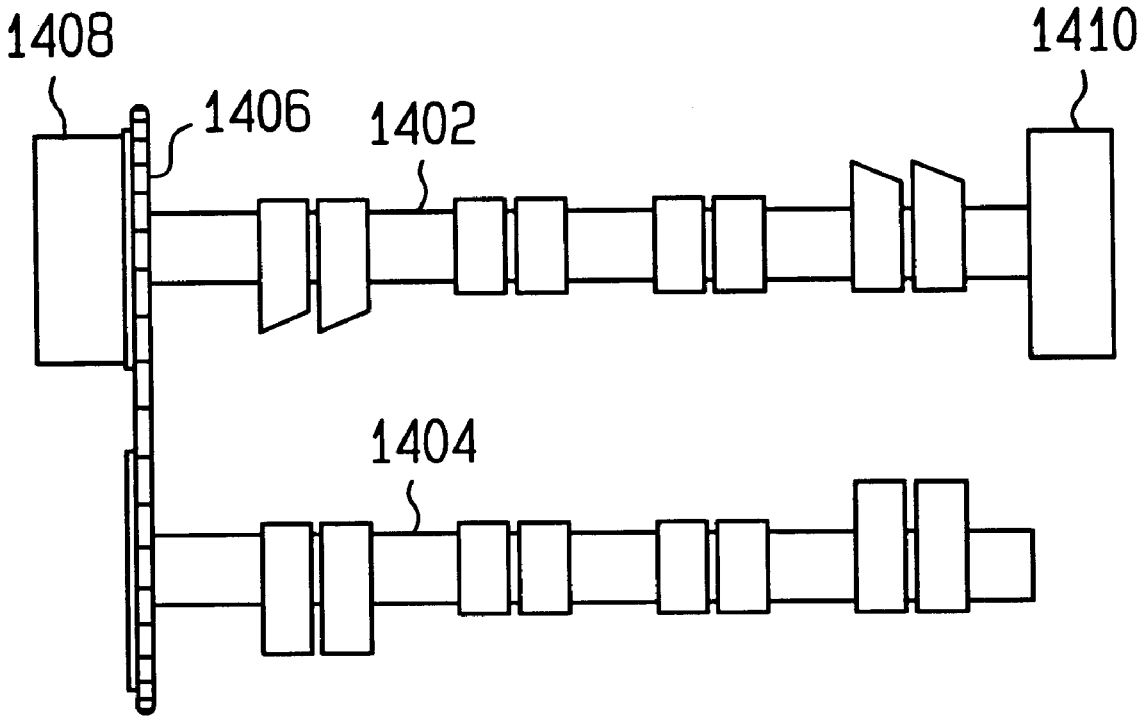
Fig.22 (Prior Art)
FIG. 22 is a schematic plan view showing an example of a prior art variable valve timing apparatus that employs a first actuator and a second actuator.

As shown in FIG. 17, in the ninth embodiment, an intake camshaft 922, and exhaust camshaft 923 are arranged parallel to one another and transversely in an engine compartment. A crankshaft, though not shown, is also parallel to the camshafts 922, 923. The intake camshaft 922 is indirectly driven by the crankshaft. The exhaust camshaft 923 is directly driven by the crankshaft. The exhaust camshaft 923 is arranged at the front side of the vehicle, while the intake camshaft 922 is arranged at the rear side of the vehicle.

A phase actuator, or first actuator 924, is arranged on the left end of the exhaust camshaft 923 (as viewed in FIG. 17) to adjust the phase of the exhaust camshaft 923 relative to the crankshaft. A lift actuator, or second actuator 925, is arranged on the right end of the exhaust camshaft 923 (as viewed in FIG. 17) to adjust the lift amount of corresponding exhaust valves with three-dimensional exhaust cams 928.

Accordingly, the first actuator 924 and the second actuator 925 are both on the same exhaust camshaft 923. Neither a first actuator nor a second actuator is arranged on the intake camshaft 922. In other words, among the two camshafts 922, 923, the first and second actuators 924, 925 are arranged on the shaft located furthest from a suspension member 994.

The transmission mechanism includes a first transmission train for transmitting the rotation of the crankshaft to the exhaust camshaft 923, and a second transmission train for transmitting the rotation of the exhaust camshaft 923 to the intake camshaft 922. The first train includes a crank timing pulley (not shown), a timing belt (not shown), and an exhaust timing pulley 924*a*, which is coupled to one end of the exhaust camshaft 923. The second train includes an exhaust cam gear 925*b* and an intake cam gear 926*b*. The first actuator 924 is incorporated in the timing pulley 924*a*, while the second actuator 925 is incorporated in the gear 925*b*.

The advantages of the ninth embodiment will now be described. The suspension member 994 often limits the layout of an engine. However, an engine employing a variable valve timing apparatus according to the ninth embodiment has the first and second actuators 924, 925 arranged on the exhaust camshaft 923, which is located farther from the suspension member 994. Therefore, although the first and second actuators 924, 925 are arranged on the same camshaft, unlike the preceding embodiments, the engine is installed without interference with the suspension member 994. Accordingly, the engine is installed in the engine compartment with fewer limitations on its location.

Furthermore, the first and second actuators 924, 925 are both arranged on the same shaft (exhaust camshaft 923). Thus, the valve timing is varied more easily in comparison with an apparatus having the first and second actuators 924, 925 arranged on different shafts, like in the preceding embodiments.

It should be apparent to those skilled in the art that the present invention may be embodied in many other specific forms without departing from the spirit or scope of the invention. For example, the present invention may be embodied as described below.

The first actuator in each of the above embodiments employs a vane type rotor. However, a helical spline type rotor may be employed in lieu of the vane type rotor.

In the sixth and seventh embodiments, the second actuators 625, 725 are arranged on the intake camshafts 622, 722, respectively, while the first actuators 624, 724 are arranged on the exhaust camshafts 623, 723, respectively. Instead, the first actuators 624, 724 may be arranged on intake camshafts 622, 722, respectively, and the second actuators 625, 725 may be arranged on the exhaust camshafts 623, 723, respectively.

In the ninth embodiment, the intake camshaft 922 is located closer to the suspension member 994. Thus, the first and second actuators 924, 925 are both arranged on the exhaust camshaft 923. However, if the exhaust camshaft 923 is arranged closer to the suspension member 994 or if the exhaust camshaft 923 interferes with other equipment in the engine compartment, the first and second actuators 924, 925 may both be arranged on the intake camshaft 922.

In the ninth embodiment, the first actuator 924 is incorporated in the exhaust timing pulley 924*a*, and the second actuator 925 is incorporated in the exhaust cam gear 925*b*. However, the first actuator 924 may be incorporated in the exhaust cam gear 925 and the second actuator 925 may be incorporated in the exhaust timing pulley 924*a*.

In the ninth embodiment, the valve transmission formed by the first transmission train, which includes the crank timing pulley, the timing belt, and the exhaust timing pulley 924*a*, and the second transmission train, which includes the exhaust and intake cam gears 925*b*, 926*b*. However, the valve transmission may be a simple structure, which only includes a crank timing pulley, a timing belt, an exhaust timing pulley, and an intake timing pulley, like the valve transmission of FIG. 1.

In each of the above embodiments, torque is transmitted from the crankshaft by timing belts and timing pulleys. However, other elements may be used to transmit the torque. For example, timing chains and timing sprockets or timing gears may be employed.

In each of the above embodiments, three-dimensional cams (FIG. 2) are employed to change the lift amount and opening duration of the corresponding valves when driven by a second actuator. However, three-dimensional cams that have profiles for changing the opening duration of the valves, but not the lift amount, may be employed instead. Further, three-dimensional cams that have profiles for changing only the closing valve timing or only the opening valve timing may also be employed.

In the first, second, sixth, seventh, and ninth embodiments, another first actuator may be arranged on the crankshaft. In this case, the additional first actuator facilitates valve timing control.

Therefore, the present examples and embodiments are to be considered as illustrative and not restrictive, and the invention is not to be limited to the details given herein, but may be modified within the scope and equivalence of the appended claims.

What is claimed is:

1. A variable valve timing apparatus employed in an engine to vary the valve timing of intake valves or exhaust valves, wherein the engine includes a crankshaft, an intake camshaft for driving the intake valves, an exhaust camshaft for driving the exhaust valves, and a transmission for transmitting rotation between the crankshaft, the intake camshaft, and the exhaust camshaft, wherein the variable valve timing apparatus comprises:

a first actuator arranged on only one of the intake camshaft and the exhaust camshaft, wherein the first actuator only adjusts the rotational phase of the camshaft on which the first actuator is arranged relative to the crankshaft; and a second actuator arranged on only the other of the intake camshaft and the exhaust camshaft, wherein the second actuator only adjusts the axial position of the other of the intake camshaft and the exhaust camshaft to adjust the valve lift of the valves driven by the camshaft on which the second actuator is arranged.

2. The variable valve timing apparatus according to claim 1, wherein the transmission includes a timing belt for transmitting the torque of the crankshaft to the intake camshaft and the exhaust camshaft.

3. The variable valve timing apparatus according to claim 1, wherein the transmission includes:

a first transmission train for transmitting the torque of the crankshaft to the intake camshaft or the exhaust camshaft, the first transmission train being formed by a combination of a timing belt and timing pulley; and a second transmission train for transmitting torque between the intake camshaft and the exhaust camshaft, the second transmission train being formed by timing gears.

4. The variable valve timing apparatus according to claim 1, wherein the first actuator is arranged on the intake camshaft and the second actuator is arranged on the exhaust camshaft.

5. The variable valve timing apparatus according to claim 1, wherein the first actuator is arranged on the exhaust camshaft and the second actuator is arranged on the intake camshaft.

6. The variable valve timing apparatus according to claim 3, wherein the crankshaft, the intake camshaft, and the exhaust camshaft are parallel to one another, each shaft having a first end and an opposite second end, wherein the first transmission train is arranged at the first ends of the shafts, and the second transmission train is arranged at the second ends of the shafts.

7. The variable valve timing apparatus according to claim 6, wherein each of the first and second actuator is incorporated in a separate timing gear of the second train transmission and each actuator is arranged on a different one of the camshafts.

8. The variable valve timing apparatus according to claim 1, wherein the engine is installed in an automobile.

9. An engine installed in an automobile, wherein the engine comprises:

a crankshaft;

intake valves;

an intake camshaft for driving the intake valves;

exhaust valves;

an exhaust camshaft for driving the exhaust valves, the crankshaft, the intake camshaft, and the exhaust camshaft being parallel to one another;

a transmission for transmitting rotation between the crankshaft, the intake camshaft, and the exhaust camshaft, wherein the valve timing of the intake valves or the exhaust valves is variable;

a first actuator arranged on only one of the intake camshaft and the exhaust camshaft, wherein the first actuator only adjusts the rotational phase of the camshaft on which the first actuator is arranged relative to the crankshaft; and a second actuator arranged on only the other of the intake camshaft and the exhaust camshaft, wherein the second actuator only adjusts the axial position of the camshaft on which it is arranged, and wherein the camshaft that is moved axially by the second actuator includes three-dimensional cams to adjust the lift amount of the corresponding valves in accordance with axial movement of the camshaft.

10. The engine according to claim 9, wherein the automobile has an engine compartment and a suspension member extending into the engine compartment, and wherein the first and second actuators are arranged on a camshaft that is furthest from the suspension member.

11. The engine according to claim 9, wherein the transmission includes a timing belt for transmitting the torque of the crankshaft to the intake camshaft and the exhaust camshaft.

12. The engine according to claim 9, wherein the transmission includes:

a first transmission train for transmitting the torque of the crankshaft to the intake camshaft or the exhaust camshaft, the first transmission train being formed by a combination of a timing belt and a timing pulley; and a second transmission train for transmitting torque between the intake camshaft and the exhaust camshaft, the second transmission train being formed by timing gears.

13. The engine according to claim 9, wherein the first actuator is arranged on the intake camshaft and the second actuator is arranged on the exhaust camshaft.

14. The engine according to claim 9, wherein the first actuator is arranged on the exhaust camshaft and the second actuator is arranged on the intake camshaft.

* * * * *